US011315490B2

(12) United States Patent
Qin et al.

(10) Patent No.: US 11,315,490 B2
(45) Date of Patent: Apr. 26, 2022

(54) PIXEL CIRCUIT HAVING A VOLTAGE AMPLIFICATION CIRCUIT AND DRIVING METHOD THEREOF, DISPLAY PANEL

(71) Applicant: BOE TECHNOLOGY GROUP CO., LTD., Beijing (CN)

(72) Inventors: Guohong Qin, Beijing (CN); Xiaochuan Chen, Beijing (CN); Shengji Yang, Beijing (CN); Pengcheng Lu, Beijing (CN); Weihai Wang, Beijing (CN); Rongrong Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 386 days.

(21) Appl. No.: 16/470,443

(22) PCT Filed: Dec. 29, 2018

(86) PCT No.: PCT/CN2018/125197
§ 371 (c)(1),
(2) Date: Jun. 17, 2019

(87) PCT Pub. No.: WO2019/214263
PCT Pub. Date: Nov. 14, 2019

(65) Prior Publication Data

US 2021/0358412 A1 Nov. 18, 2021

(30) Foreign Application Priority Data

May 9, 2018 (CN) ..... 201810439112.5

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0426* (2013.01); *G09G 2310/0291* (2013.01)

(58) Field of Classification Search
CPC ..... G09G 3/3258
(Continued)

(56) References Cited

U.S. PATENT DOCUMENTS 7,868,855 B2 1/2011 Park
9,720,535 B2 8/2017 Yang et al.
(Continued)

FOREIGN PATENT DOCUMENTS

CN 101149899 A 3/2008
CN 103956138 A 7/2014
(Continued)

OTHER PUBLICATIONS

Chinese Office Action in Chinese Application No. 201810439112.5, dated Jul. 20, 2020 with English translation.
(Continued)

*Primary Examiner* — Long D Pham
(74) *Attorney, Agent, or Firm* — Collard & Roe, P.C.

(57) ABSTRACT

A pixel circuit, a driving method thereof and a display panel are disclosed. The pixel circuit includes a data writing circuit, a light-emitting drive circuit, and a voltage amplification circuit; the data writing circuit is electrically connected with a first node and is configured to write a data signal to the first node under control of a scan signal; two ends of the voltage amplification circuit are electrically connected with the first node and a second node respectively, and the voltage amplification circuit are configured to obtain an amplified voltage signal based on the data signal and write the amplified voltage signal to the second node; and the light-emitting drive circuit is electrically connected with
(Continued)

the second node and is configured to drive a light-emitting component to emit light under control of the amplified voltage signal.

18 Claims, 10 Drawing Sheets

(58) Field of Classification Search
USPC ..... 345/55
See application file for complete search history.

(56) References Cited

U.S. PATENT DOCUMENTS

| | | | | |
|---|---|---|---|---|
| 9,746,979 | B2 | 8/2017 | Yang | |
| 9,842,527 | B2 | 12/2017 | Morita | |
| 10,388,218 | B2 | 8/2019 | Dong | |
| 2005/0231448 | A1* | 10/2005 | Tanabe | G09G 3/3233 345/76 |
| 2014/0168038 | A1 | 6/2014 | Kim | |
| 2014/0218272 | A1* | 8/2014 | Kikuchi | G09G 3/3266 345/77 |
| 2016/0267837 | A1 | 9/2016 | Wang et al. | |
| 2019/0043422 | A1 | 2/2019 | Lu et al. | |

FOREIGN PATENT DOCUMENTS

| | | | |
|---|---|---|---|
| CN | 103996377 | A | 8/2014 |
| CN | 104091559 | A | 10/2014 |
| CN | 105529005 | A | 4/2016 |
| CN | 105825813 | A | 8/2016 |
| CN | 105845081 | A | 8/2016 |
| CN | 106486041 | A | 3/2017 |
| CN | 106910465 | A | 6/2017 |
| CN | 107146578 | A | 9/2017 |
| JP | 2004-157450 | A | 6/2004 |
| KR | 10-2011-0071983 | A | 6/2011 |

OTHER PUBLICATIONS

International Search Report of PCT/CN2018/125197 in Chinese, dated Mar. 27, 2019, with English translation.

* cited by examiner

PIXEL CIRCUIT HAVING A VOLTAGE AMPLIFICATION CIRCUIT AND DRIVING METHOD THEREOF, DISPLAY PANEL

CROSS REFERENCE TO RELATED APPLICATIONS

This application is the National Stage of PCT/CN2018/125197 filed on Dec. 29, 2018, which claims priority under 35 U.S.C. § 119 of Chinese Application No. 201810439112.5 filed on May 9, 2018, the disclosure of which is incorporated by reference.

TECHNICAL FIELD

Embodiments of the present disclosure relate to a pixel circuit and a driving method thereof, and a display panel.

BACKGROUND

At present, organic light emitting diode (OLED) display panels have broad development prospects due to their characteristics of being bendable, high contrast, low power consumption and so on. The OLED display panels can be widely used in mobile phones, computers, full-color television, digital cameras, personal digital assistants and other electronic products.

A silicon-based OLED display panel has a single crystal silicon chip as a substrate, and a pixel matrix and its drive circuit are directly integrated on the single crystal silicon chip. Compared with a traditional OLED display panel, the silicon-based OLED display panel has advantages of long life, small volume, high resolution and the like, and can be applied to display applications such as virtual reality (VR) and augmented reality (AR).

SUMMARY

At least some embodiments of the present disclosure provide a pixel circuit, and the pixel circuit comprises: a light-emitting component, a data writing circuit, a light-emitting drive circuit and a voltage amplification circuit; the data writing circuit is electrically connected to a first node and is configured to write a data signal to the first node under control of a scan signal; two ends of the voltage amplification circuit are electrically connected to the first node and a second node respectively, and the voltage amplification circuit are configured to obtain an amplified voltage signal based on the data signal and write the amplified voltage signal to the second node; and the light-emitting drive circuit is electrically connected to the second node and is configured to drive the light-emitting component to emit light under control of the amplified voltage signal.

For example, in the pixel circuit provided by some embodiments of the present disclosure, the voltage amplification circuit comprises at least one of a field effect transistor amplification sub-circuit and a bipolar transistor amplification sub-circuit.

For example, in the pixel circuit provided by some embodiments of the present disclosure, the bipolar transistor amplification sub-circuit comprises a first transistor, a bipolar transistor, a first resistor, a second resistor, a third resistor and a first capacitor; a first electrode of the first transistor is electrically connected with a first power terminal, and a second electrode of the first transistor is electrically connected with a first end of the first capacitor; a first end of the first resistor is electrically connected with the first end of the first capacitor, and a second end of the first resistor is electrically connected with a control electrode of the bipolar transistor; a first end of the second resistor is electrically connected with a second power terminal, and a second end of the second resistor is electrically connected with a first end of the third resistor; a second end of the third resistor is electrically connected with a first electrode of the bipolar transistor; a second electrode of the bipolar transistor is electrically connected with a third power terminal; and a second end of the first capacitor is electrically connected with a fourth power terminal.

For example, in the pixel circuit provided by some embodiments of the present disclosure, the control electrode of the bipolar transistor is a base electrode, the first electrode of the bipolar transistor is a collector, and the second electrode of the bipolar transistor is an emitter.

For example, in the pixel circuit provided by some embodiments of the present disclosure, the voltage amplification circuit comprises a first-stage amplification circuit, the first-stage amplification circuit comprises the bipolar transistor amplification sub-circuit, a control electrode of a first transistor of the first-stage amplification circuit is electrically connected to the first node, and a first end of a third resistor of the first-stage amplification circuit is electrically connected to the second node.

For example, in the pixel circuit provided by some embodiments of the present disclosure, the voltage amplification circuit comprises a first-stage amplification circuit and a second-stage amplification circuit which are cascaded, and the first-stage amplification circuit and the second-stage amplification circuit each comprises the bipolar transistor amplification sub-circuit; a control electrode of a first transistor of the first-stage amplification circuit is electrically connected to the first node; a first end of a third resistor of the first-stage amplification circuit is electrically connected with a control electrode of a first transistor of the second-stage amplification circuit; and a first end of a third resistor of the second-stage amplification circuit is electrically connected to the second node.

For example, in the pixel circuit provided by some embodiments of the present disclosure, the voltage amplification circuit comprises a plurality of amplification circuits which are cascaded, and each of the plurality of amplification circuits comprises the bipolar transistor amplification sub-circuit, in addition to a first-stage amplification circuit and a last-stage amplification circuit, a control electrode of a first transistor of a current-stage amplification circuit is electrically connected with a first end of a third resistor of a previous-stage amplification circuit; and a first end of a third resistor of the current-stage amplification circuit is electrically connected with a control electrode of a first transistor of a next-stage amplification circuit; a control electrode of a first transistor of the first-stage amplification circuit is electrically connected with the first node, and a first end of a third resistor of the last-stage amplification circuit is electrically connected with the second node.

For example, in the pixel circuit provided by some embodiments of the present disclosure, a resistance value of the first resistor is smaller than a resistance value of the second resistor, and the resistance value of the second resistor is smaller than a resistance value of the third resistor.

For example, in the pixel circuit provided by some embodiments of the present disclosure, the field effect transistor amplification sub-circuit comprises a second transistor and a fourth resistor, a first electrode of the second transistor is electrically connected with a first power terminal, and a second electrode of the second transistor is electrically connected with a first end of the fourth resistor; and a second end of the fourth resistor is electrically connected with a third power terminal.

For example, in the pixel circuit provided by some embodiments of the present disclosure, the voltage amplification circuit comprises a first-stage amplification circuit, and the first-stage amplification circuit comprises the field effect transistor amplification sub-circuit, a control electrode of a second transistor of the first-stage amplification circuit is electrically connected with the first node, and a second electrode of the second transistor of the first-stage amplification circuit is electrically connected with the second node.

For example, in the pixel circuit provided by some embodiments of the present disclosure, the voltage amplification circuit comprises a first-stage amplification circuit and a second-stage amplification circuit which are cascaded, and the first-stage amplification circuit and the second-stage amplification circuit each comprises the field effect transistor amplification sub-circuit, a control electrode of a second transistor of the first-stage amplification circuit is electrically connected with the first node; a second electrode of the second transistor of the first-stage amplification circuit is electrically connected with a control electrode of a second transistor of the second-stage amplification circuit; and a second electrode of the second transistor of the second-stage amplification circuit is electrically connected with the second node.

For example, in the pixel circuit provided by some embodiments of the present disclosure, the voltage amplification circuit comprises a plurality of amplification circuits which are cascaded, and each of the plurality of amplification circuits comprises the field effect transistor amplification sub-circuit, in addition to a first-stage amplification circuit and a last-stage amplification circuit, a control electrode of a second transistor of a current-stage amplification circuit is electrically connected with a second electrode of a second transistor of a previous-stage amplification circuit; and a second electrode of the second transistor of the current-stage amplification circuit is electrically connected with a control electrode of a second transistor of a next-stage amplification circuit; a control electrode of a second transistor of the first-stage amplification circuit is electrically connected to the first node, and a second electrode of a second transistor of the last-stage amplification circuit is electrically connected to the second node.

For example, in the pixel circuit provided by some embodiments of the present disclosure, the field effect transistor amplification sub-circuit comprises a second transistor and a fourth resistor, a first electrode of the second transistor is electrically connected with a first power terminal, and a second electrode of the second transistor is electrically connected with a first end of the fourth resistor; and a second end of the fourth resistor is electrically connected with a third power terminal.

For example, in the pixel circuit provided by some embodiments of the present disclosure, the voltage amplification circuit comprises a first-stage amplification circuit and a second-stage amplification circuit which are cascaded, and the first-stage amplification circuit comprises the bipolar transistor amplification sub-circuit, and the second-stage amplification circuit comprises the field effect transistor amplification sub-circuit; a control electrode of a first transistor of the first-stage amplification circuit is electrically connected with the first node; a first end of a third resistor of the first-stage amplification circuit is electrically connected with a control electrode of a second transistor of the second-stage amplification circuit; and a second electrode of the second transistor of the second-stage amplification circuit is electrically connected with the second node.

For example, in the pixel circuit provided by some embodiments of the present disclosure, the voltage amplification circuit comprises a first-stage amplification circuit and a second-stage amplification circuit which are cascaded, and the first-stage amplification circuit comprises the field effect transistor amplification sub-circuit, and the second-stage amplification circuit comprises the bipolar transistor amplification sub-circuit; a control electrode of a second transistor of the first-stage amplification circuit is electrically connected with the first node; a second electrode of the second transistor of the first-stage amplification circuit is electrically connected with a control electrode of a first transistor of the second-stage amplification circuit; and a first end of a third resistor of the second-stage amplification circuit is electrically connected with the second node.

For example, the pixel circuit provided by some embodiments of the present disclosure further comprises a storage circuit, the storage circuit is configured to store the amplified voltage signal, the storage circuit comprises a second capacitor, and the light-emitting drive circuit comprises a light-emitting drive transistor, and the data writing circuit comprises a data writing transistor; a first electrode of the light-emitting drive transistor is electrically connected with a first drive power terminal, a second electrode of the light-emitting drive transistor is electrically connected with the light-emitting component, and a control electrode of the light-emitting drive transistor is electrically connected with the second node; a first electrode of the data writing transistor is connected with a data line to receive the data signal, a second electrode of the data writing transistor is electrically connected with the first node, and a control electrode of the data writing transistor is connected with a scan signal line to receive the scan signal; and a first end of the second capacitor is electrically connected with the second node, and a second end of the second capacitor is grounded or electrically connected to the first drive power terminal.

For example, the pixel circuit provided by some embodiments of the present disclosure further comprises a light-emitting control circuit, the light-emitting control circuit is configured to control the light-emitting drive circuit to drive the light-emitting component to emit light under control of a light-emitting control signal, and the light-emitting control circuit comprises a light-emitting control transistor; and a control electrode of the light-emitting control transistor is configured to receive the light-emitting control signal, a first electrode of the light-emitting control transistor is electrically connected with the light-emitting drive circuit, and a second electrode of the light-emitting control transistor is electrically connected with the light-emitting component.

For example, in the pixel circuit provided by some embodiments of the present disclosure, the light-emitting component, the data writing circuit, the light-emitting drive circuit and the voltage amplification circuit are formed on a silicon substrate.

At least some embodiments of the present disclosure further provide a driving method applied to any one of the pixel circuits mentioned above, and the driving method comprises: in a data writing phase, writing the data signal into the voltage amplification circuit, obtaining the amplified voltage signal by the voltage amplification circuit based on the data signal, and writing the amplified voltage signal into the light-emitting drive circuit; and in a light-emitting phase, driving the light-emitting component to emit light by the light-emitting drive circuit based on the amplified voltage signal.

For example, in driving method provided by some embodiments of the present disclosure, the voltage amplification circuit comprises a bipolar transistor amplification sub-circuit, and the bipolar transistor amplification sub-circuit comprises a first transistor and a bipolar transistor, obtaining the amplified voltage signal by the voltage amplification circuit based on the data signal comprises: writing the data signal to a control electrode of the first transistor, and controlling the first transistor to be in a saturated state to obtain a saturation current; controlling the bipolar transistor to be in an amplification state, and amplifying the saturation current by the bipolar transistor to obtain an amplified current; and obtaining the amplified voltage signal based on the amplified current.

For example, in the driving method provided by some embodiments of the present disclosure, the voltage amplification circuit comprises a field effect transistor amplification sub-circuit, and the field effect transistor amplification sub-circuit comprises a second transistor and a fourth resistor; and obtaining the amplified voltage signal by the voltage amplification circuit based on the data signal comprises: writing the data signal to a control electrode of the second transistor, and controlling the second transistor to be in a saturated state to obtain a saturation current; and obtaining the amplified voltage signal based on the saturation current and the fourth resistor.

At least some embodiments of the present disclosure further provide a display panel, and the display panel comprises a pixel circuit according to any one of the pixel circuits mentioned above.

BRIEF DESCRIPTION OF THE DRAWINGS

In order to clearly illustrate the technical solution of the embodiments of the present disclosure, the drawings of the embodiments will be briefly described in the following, it is obvious that the described drawings are only related to some embodiments of the present disclosure and thus are not limitative of the present disclosure.

DETAILED DESCRIPTION

In order to make objects, technical details and advantages of embodiments of the disclosure clear, the technical solutions of the embodiments will be described in a clearly and fully understandable way in connection with the related drawings. It is apparent that the described embodiments are just a part but not all of the embodiments of the disclosure. Based on the described embodiments herein, those skilled in the art can obtain, without any inventive work, other embodiment(s) which should be within the scope of the disclosure.

Unless otherwise defined, all the technical and scientific terms used herein have the same meanings as commonly understood by one of ordinary skill in the art to which the present invention belongs. The terms "first," "second," etc., which are used in the description and claims of the present application, are not intended to indicate any sequence, amount or importance, but distinguish various components. The terms "comprises," "comprising," "includes," "including," etc., are intended to specify that the elements or the objects stated before these terms encompass the elements or the objects listed after these terms as well as equivalents thereof, but do not exclude other elements or objects. The phrases "connect", "connected", etc., are not intended to define a physical connection or mechanical connection, but may include an electrical connection which is direct or indirect. The terms "on," "under," "right," "left" and the like are only used to indicate relative position relationship, and when the position of an object is described as being changed, the relative position relationship may be changed accordingly.

Detailed descriptions of some known functions and known components are omitted in the present disclosure to keep the following illustrations of embodiments of the present disclosure clear and concise.

Figure 1:
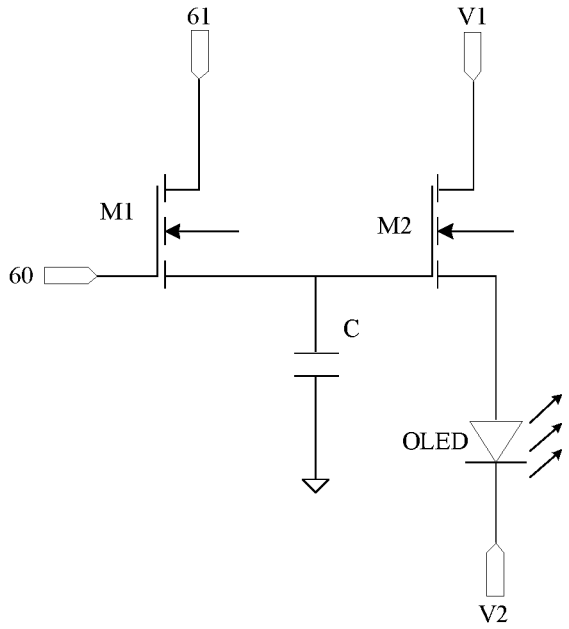
FIG. 1 is a schematic structural diagram of a pixel circuit of an organic light-emitting diode display panel.

FIG. 1 is a schematic structural diagram of a pixel circuit of an organic light-emitting diode display panel. As illustrated in FIG. 1, the pixel circuit comprises a switching transistor M1, a drive transistor M2 and a capacitor C. In a case where a gate line 60 inputs a turn-on voltage signal (for example, a high voltage signal) to a gate electrode of the switching transistor M1, the switching transistor M1 is turned on, and a data voltage on a data line 61 is written to an end of the capacitor C via the switching transistor M1. Under control of the data voltage, the drive transistor M2 is turned on, and a first power terminal V1, the drive transistor M2, an organic light-emitting diode (OLED) and a second power terminal V2 form a current path. In this situation, the drive transistor M2 is in a saturated state, and a saturation current output by the drive transistor M2 can drive the organic light-emitting diode (OLED) to emit light with a corresponding intensity. According to a saturation current formula of the drive transistor M2, the saturation current $I_{oled}$ of the drive transistor M2 can be expressed as:

$$I_{oled}=\frac{1}{2}K(V_{data}-V_{th})^2,$$

where $V_{data}$ is the data voltage, $V_{th}$ is a threshold voltage of the drive transistor M2, and K is a constant related to the drive transistor M2. In the pixel circuit, the luminous brightness of the organic light-emitting diode (OLED) is determined by the data voltage. If an amplitude of the data voltage $V_{data}$ is small, the organic light-emitting diode (OLED) is difficult to achieve relatively high luminous brightness, and a display effect and an application range of the display panel may be adversely affected correspondingly.

The embodiments of the present disclosure provide a pixel circuit, a driving method of the pixel circuit and a display panel, and the pixel circuit can increase a voltage of a control terminal of a light-emitting drive circuit, thereby increasing a driving current for driving a light-emitting component to emit light and improving the brightness of the display panel.

For example, in the present disclosure, a first transistor, a second transistor, a data writing transistor, a light-emitting control transistor, a light-emitting drive transistor and the like may be field effect transistors. According to the characteristics of the field effect transistors, the field effect transistors may be classified into N-type transistors and P-type transistors, for clarity, the embodiments of the present disclosure illustrate the technical solutions of the present disclosure in detail by taking a case that the field effect transistors are N-type transistors (for example, N-type MOS transistors (NMOS)) as an example. However, the field effect transistors in the embodiments of the present disclosure are not limited to the N-type transistors, and those skilled in the art may also implement functions of one or more of the field effect transistors in the embodiments of the present disclosure by using the P-type transistors (for example, P-type MOS transistors (PMOS)) according to actual requirements.

It should be noted that, the field effect transistors used in the embodiments of the present disclosure may be thin film transistors and other field effect transistors or other switching devices having same characteristics, and the thin film transistors include oxide semiconductor thin film transistors, amorphous silicon thin film transistors or polysilicon thin film transistors and so on. A source electrode and a drain electrode of each of the field effect transistors are symmetrical in structure, so the source electrode and the drain electrode of each of the field effect transistors may be indistinguishable in physical structure. In the embodiments of the present disclosure, in order to distinguish two electrodes of the field effect transistor except a gate electrode of the field effect transistor as a control electrode, one of the two electrodes is directly described as a first electrode and the other of the two electrodes is directly described as a second electrode. Therefore, the first electrode and the second electrode of all or part of the field effect transistors in the embodiments of the present disclosure are interchangeable as required.

Some embodiments of the present disclosure are described in detail below in connection with the accompanying drawings, but the present disclosure is not limited to these specific embodiments.

Figure 2:
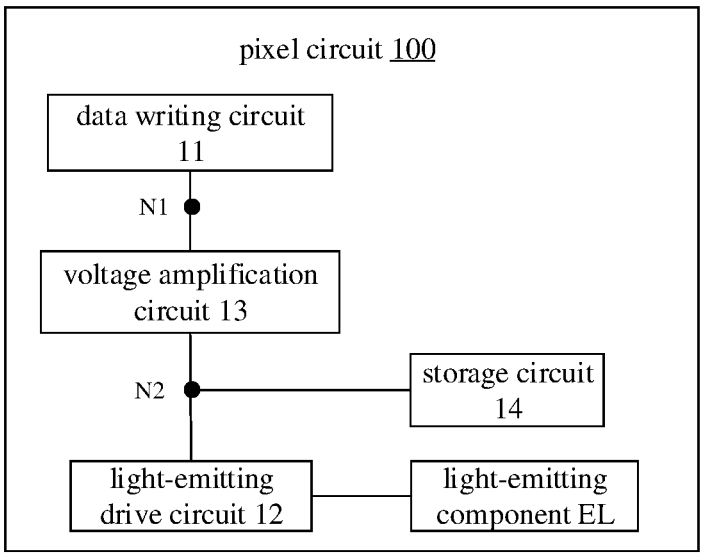
FIG. 2 is a schematic block diagram of a pixel circuit provided by some embodiments of the present disclosure.
Figure 3A:
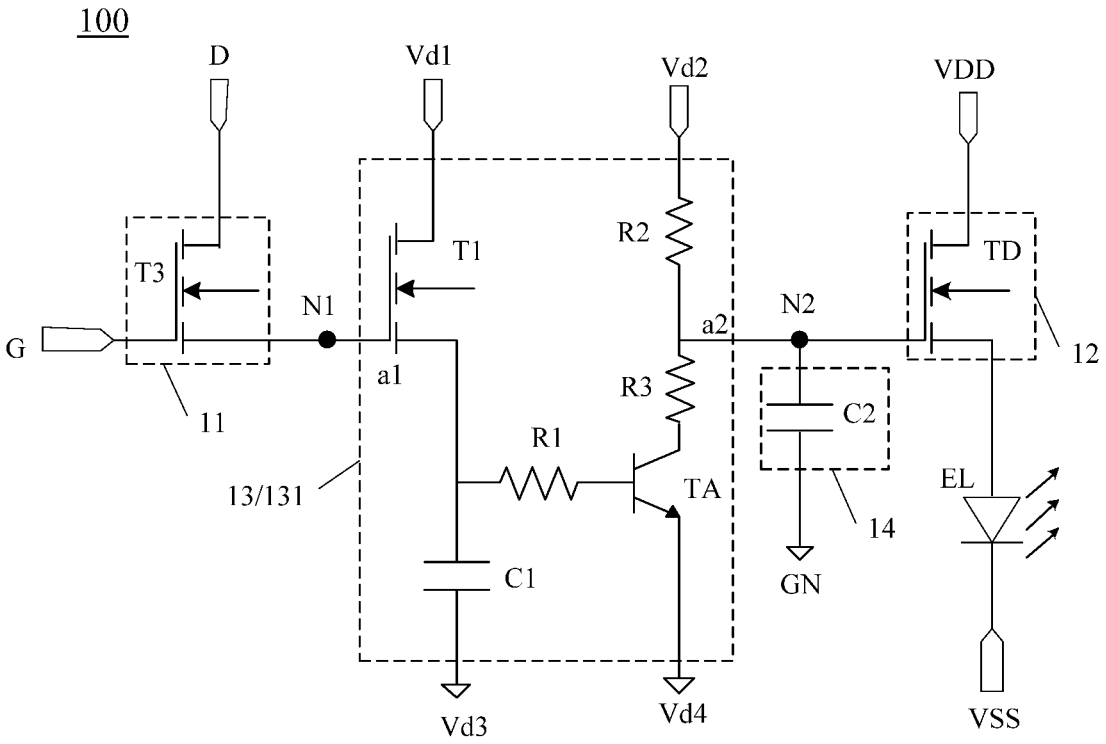
FIG. 3A is a schematic structural diagram of a pixel circuit provided by some embodiments of the present disclosure.

FIG. 2 is a schematic block diagram of a pixel circuit provided by some embodiments of the present disclosure. FIG. 3A is a schematic structural diagram of a pixel circuit provided by some embodiments of the present disclosure.

For example, as illustrated in FIG. 2 and FIG. 3A, a pixel circuit 100 provided in the embodiment of the present disclosure comprises a light-emitting component EL, a data writing circuit 11, a light-emitting drive circuit 12 and a voltage amplification circuit 13. The data writing circuit 11 is electrically connected to a first node N1 and is configured to write the data signal to the first node N1 under control of a scan signal. Two ends of the voltage amplification circuit 13 are electrically connected to the first node N1 and a second node N2 respectively, and the voltage amplification circuit 13 are configured to obtain an amplified voltage signal based on the data signal and write the amplified voltage signal into the second node N2. A control terminal of the light-emitting drive circuit 12 is electrically connected with the second node N2, and the light-emitting drive circuit 12 is configured to drive the light-emitting component EL to emit light under the control of the amplified voltage signal at the second node N2. For example, the control terminal of the light-emitting drive circuit 12 is electrically connected to the second node N2, so that the voltage amplification circuit 13 can write the amplified voltage signal to the control terminal of the light-emitting drive circuit 12.

For example, as illustrated in FIG. 3A, the two ends of the voltage amplification circuit 13 are a first end a1 and a second end a2 respectively, the first end a1 of the voltage amplification circuit 13 is electrically connected with the first node N1, and the second end a2 of the voltage amplification circuit 13 is electrically connected with the second node N2.

For example, in a light-emitting phase, a driving current generated by the light-emitting drive circuit 12 is positively correlated with a modulus value of a voltage at the control terminal of the light-emitting drive circuit 12, because a modulus value of the amplified voltage signal is larger than a modulus value of the data signal, that is to say, the voltage amplification circuit 13 can increase the voltage of the control terminal of the light-emitting drive circuit 12, so that the pixel circuit can increase the driving current for driving the driving light-emitting component EL to emit light and improve the brightness of the display panel.

It should be noted that, in the present disclosure, the "modulus value" of a signal represent an absolute value of the signal.

For example, the pixel circuit 100 can be applied to a display panel, or the like. The light-emitting component EL, the data writing circuit 11, the light-emitting drive circuit 12 and the voltage amplification circuit 13 can be formed on a silicon substrate, so that the pixel circuit 100 can be applied to a silicon-based OLED display panel. The silicon substrate may be various types of silicon substrates, such as a monocrystalline silicon, an SOI substrate, etc.

For example, in different examples, the voltage amplification circuit 13 may comprise at least one of a field effect transistor amplification sub-circuit and a bipolar transistor amplification sub-circuit.

For example, in the example shown in FIG. 3A, the bipolar transistor amplification sub-circuit can comprise a first transistor T1, a bipolar transistor TA, a first resistor R1, a second resistor R2, a third resistor R3 and a first capacitor C1. A first electrode of the first transistor T1 is electrically connected with a first power terminal $V_{d1}$, and a second electrode of the first transistor T1 is electrically connected with a first end of the first capacitor C1. A first end of the first resistor R1 is electrically connected with the first end of the first capacitor C1, a second end of the first resistor R1 is electrically connected with a control electrode of the bipolar transistor TA; a first end of the second resistor R2 is electrically connected with a second power terminal $V_{d2}$, and a second end of the second resistor R2 is electrically connected with a first end of the third resistor R3. A second end of the third resistor R3 is electrically connected to a first electrode of the bipolar transistor TA. A second electrode of the bipolar transistor TA is electrically connected with a third power terminal $V_{d3}$, and a second end of the first capacitor C1 is electrically connected with a fourth power terminal $V_{d4}$.

For example, both the third power terminal Vd3 and the fourth power terminal Vd4 can be grounded. For example, the third power terminal Vd3 and the fourth power terminal Vd4 can be the same power terminal, that is, the second electrode of the bipolar transistor TA and the second end of the first capacitor C1 are electrically connected with the same power terminal.

For example, the second electrode of the bipolar transistor TA may also be grounded through a current source, that is, the second electrode of the bipolar transistor TA is electrically connects with a first end of the current source, and a second end of the current source is grounded. The current source can provide a stable current to ensure the stability and the response speed of a current flowing through the second resistor R2, the third resistor R3 and the bipolar transistor TA.

For example, the first capacitor C1 is configured to maintain a voltage at the first end of the first resistor R1, for example, the first capacitor C1 is configured to maintain the voltage at the first end of the first resistor R1 in a case where the first transistor T1 is turned off, so that the stability of the voltage at the first end of the first resistor R1 is guaranteed.

For example, the first power terminal Vd1 and the second power terminal Vd2 may be voltage sources to output constant positive voltages. A first power signal output by the first power terminal Vd1 is smaller than a second power signal output by the second power terminal Vd2. The second power signal is used to ensure that the bipolar transistor TA is in an amplification state.

For example, the first power signal output by the first power terminal Vd1 can be set according to actual situations, as long as the first transistor T1 can be in a saturated state in a data writing phase, the present disclosure is not limited thereto.

For example, the control electrode of the bipolar transistor TA is base electrode, the first electrode of the bipolar transistor TA is a collector, and the second electrode of the bipolar transistor TA is an emitter. That is to say, the bipolar transistor amplification sub-circuit can be a common emitter amplifier circuit, and the common emitter amplifier circuit is capable of amplifying a small current signal and matching requirements of a semiconductor silicon-based integrated process.

For example, the bipolar transistor TA can be fabricated on a silicon substrate by a semiconductor integrated process, and the bipolar transistor TA can be an NPN type silicon tube or a PNP type silicon tube.

For example, a resistance value of the first resistor R1 is less than a resistance value of the second resistor R2. The resistance value of the second resistor R2 is less than a resistance value of the third resistor R3, for example, the resistance value of the second resistor R2 may be half of the resistance value of the third resistor R3. For example, in some examples, the resistance value of the first resistor R1 may be 0.1 ohms, the resistance value of the second resistor R2 may be 5 ohms, and the resistance value of the third resistor R3 may be 10 ohms. Because the common emitter amplifier circuit has a large amplification factor, the input impedance of the common emitter amplifier circuit is smaller than the output impedance the common emitter amplifier circuit, that is, the resistance value of the first resistor R1 can be small, then a small current signal can be effectively amplified, that is, the common emitter amplifier circuit has a good amplification effect on the small current signal. Because the resistance value of the first resistor R1 is small, the first resistor R1 can be integrated on the silicon substrate, and the second resistor R2 can be externally disposed, that is, the second resistor R2 may not be disposed on the silicon substrate, so that the signal traces of the bipolar transistor amplification sub-circuit can be thinner, and a volume of a silicon wafer can be saved, and an overall integration of the silicon-based OLED can be improved.

For example, as illustrated in FIG. 3A, the voltage amplification circuit 13 comprises a first-stage amplification circuit 131, and is a single-stage amplification mode. The first-stage amplification circuit 131 comprises a bipolar transistor amplification sub-circuit. The first end a1 of the voltage amplification circuit 13 is a control electrode of a first transistor T1 of the first-stage amplification circuit 131, and the second end a2 of the voltage amplification circuit 13 is a first end of a third resistor R3 of the first-stage amplification circuit, that is, the control electrode of the first transistor T1 of the first-stage amplification circuit 131 is electrically connected with the first node N1, and the first end of the third resistor R3 of the first-stage amplification circuit is electrically connected with the second node N2. As illustrated in FIG. 3A, a second end of the second resistor R2 is also electrically connected with the second node N2.

For example, in the example shown in FIG. 3A, the amplified voltage signal (that is, the voltage signal at the second node N2) may be expressed as:

$$V_{N2}=\beta\times(\tfrac{1}{2}K_{T1}(V_{data}-V_{thT1})^2)\times r3,$$

where, $V_{N2}$ is the amplified voltage signal, r3 is the resistance value of the third resistor R3, and β is an amplification factor of the bipolar transistor TA, for example, β may range from 100 to 200, for example, 100, 150 or 200; $K_{T1}$ is a process constant of the first transistor T1; $V_{thT1}$ is a threshold voltage of the first transistor T1; and $V_{data}$ is a data signal.

For example, in an example, the process constant $K_{T1}$ of the first transistor T1 may be $8*10^{-4}$, the amplification factor β of the bipolar transistor TA may be 100, the resistance value R3 of the third resistor r3 may be 10 ohms, the threshold voltage $V_{thT1}$ of the first transistor T1 may be 0.5V, and the data signal $V_{data}$ may be 4V. Thus, the amplified voltage signal $V_{N2}$ can be calculated as:

$$V_{N2}=\beta\times(1/2K_{T1}(V_{data}-V_{thT1})^2)\times r3=100\times(1/2\times8\times10^{-4}\times(4-0.5)^2)\times10=4.9V$$

As can be seen from the above, the amplified voltage signal $V_{N2}$ is about 1.225 times as large as an original data signal $V_{data}$. A modulus value of the amplified voltage signal $V_{N2}$ is larger than a modulus value of the original data signal $V_{data}$, that is to say, the modulus value of the voltage at the second node N2 (that is, the voltage at the control terminal of the light-emitting drive circuit 12) is increased.

Figure 3B:
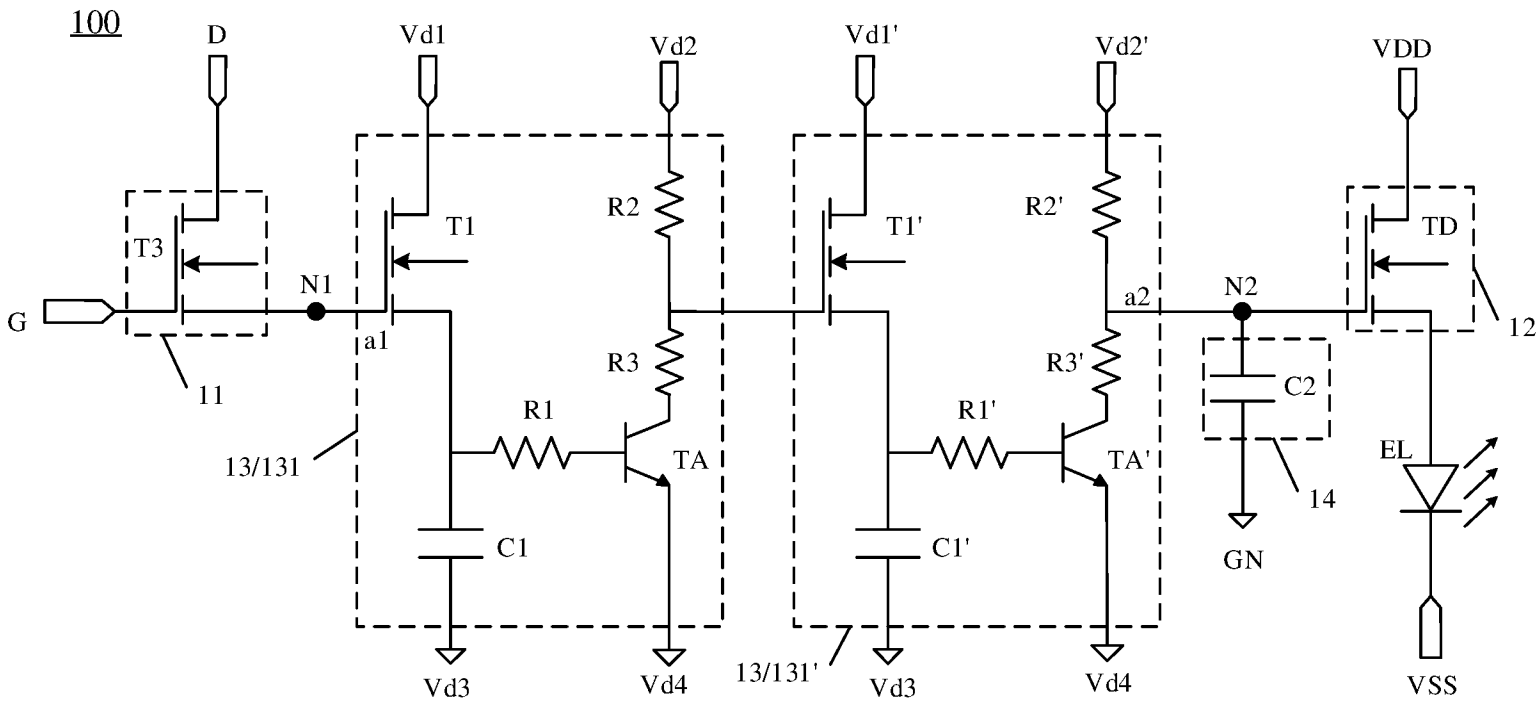
FIG. 3B is a schematic structural diagram of another pixel circuit provided by some embodiments of the present disclosure.

FIG. 3B is a schematic structural diagram of another pixel circuit provided by some embodiments of the present disclosure. For example, as illustrated in FIG. 3B, the voltage amplification circuit 13 comprises a first-stage amplification circuit 131 and a second-stage amplification circuit 131' which are cascaded, and is a multi-stage amplification mode. For example, each stage of the voltage amplification circuit 13 is of the same type and substantially has the same configuration, or at least two stages of the voltage amplification circuit 13 include different types of amplification circuits, etc.

For example, in the example shown in FIG. 3B, the first-stage amplification circuit 131 and the second-stage amplification circuit 131' each comprises the bipolar transistor amplification sub-circuit. The first-stage amplification circuit 131 can receive a data signal and obtain a first amplified voltage signal based on the data signal; the second-stage amplification circuit 131' can receive the first amplified voltage signal and obtain a second amplified voltage signal based on the first amplified voltage signal, in which a modulus value of the first amplified voltage signal is larger than a modulus value of the data signal, and a modulus value of the second amplified voltage signal is larger than a modulus value of the first amplified voltage signal. Thus, compared with the voltage amplification circuit 13 shown in FIG. 3A, the voltage amplification circuit 13 shown in FIG. 3B can further increase the voltage written to the control terminal of the light-emitting drive circuit 12.

For example, as illustrated in FIG. 3B, the first end a1 of the voltage amplification circuit 13 is a control electrode of a first transistor T1 of the first-stage amplification circuit 131, and the second end a2 of the voltage amplification circuit 13 is a first end of a third resistor R3' of the second-stage amplification circuit 131'. That is, the control electrode of the first transistor T1 of the first-stage amplification circuit 131 is electrically connected to the first node N1, and the first end of the third resistor R3' of the second-stage amplification circuit 131' is electrically connected to the second node N2. A first end of a third resistor R3 of the first-stage amplification circuit 131 is electrically connected with a control electrode of a first transistor T1' of the second-stage amplification circuit 131'.

For example, the first transistor T1, the bipolar transistor TA, the first resistor R1, the second resistor R2, the third resistor R3 and the first capacitor C1 in the first-stage amplification circuit 131 have the same parameters as the first transistor T1', the bipolar transistor TA', the first resistor R1', the second resistor R2', the third resistor R3', and the first capacitor C1' in the second-stage amplification circuit 131', respectively. However, the present disclosure is not limited thereto, the elements in the first-stage amplification circuit 131 may be at least partially different from the corresponding elements in the second-stage amplification circuit 131', for example, the first transistor T1 in the first-stage amplification circuit 131 and the first transistor T1' in the second-stage amplification circuit 131' are different, for example, have different turn-on voltages.

For example, a first electrode of the first transistor T1 of the first-stage amplification circuit 131 is electrically connected with a first power terminal Vd1, and a first end of the second resistor R2 of the first-stage amplification circuit 131 is electrically connected with a second power terminal Vd2. A first electrode of the first transistor T1' of the second-stage amplification circuit 131' is electrically connected with a first power terminal Vd1', and a first end of the second resistor R2' of the second-stage amplification circuit 131' is electrically connected with a second power terminal Vd2'. A first power signal output by the first power terminal Vd1 and a first power signal output by the first power terminal Vd1' may be the same or different from each other, and a second power signal output by the second power terminal Vd2 and a second power signal output by the second power terminal Vd2' may be the same or different from each other, as long as the first power signal output by the first power terminal Vd1 is less than the second power signal output by the second power terminal Vd2, the first power signal output by the first power terminal Vd1' is less than the second power signal output by the second power terminal Vd2', the first power signal output by the first power terminal Vd1 can make the first transistor T1 be in a saturated state in the data writing phase, the first power signal output by the first power terminal Vd1' can make the first transistor T1' be in a saturated state in the data writing phase, the second power signal output by the second power terminal Vd2 can make the bipolar transistor TA be in an amplification state, and the second power signal output by the second power terminal Vd2' can make the bipolar transistor TA' be in the amplification state.

Figure 3C:
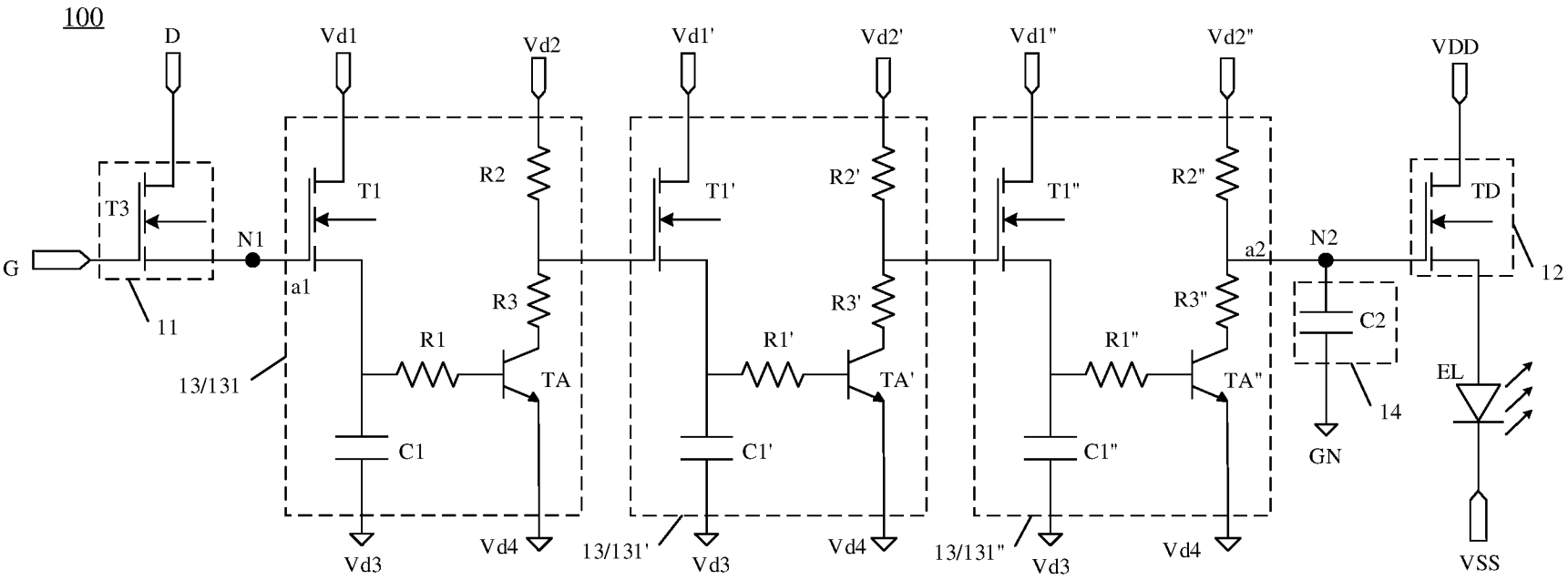
FIG. 3C is a schematic structural diagram of still another pixel circuit provided by some embodiments of the present disclosure.

FIG. 3C is a schematic structural diagram of another pixel circuit provided by some embodiments of the present disclosure. The voltage amplification circuit 13 comprises a plurality of amplification circuits which are cascaded, each of the plurality of amplification circuits comprises the bipolar transistor amplification sub-circuit. In addition to a first-stage amplification circuit and a last-stage amplification circuit, a control electrode of a first transistor of a current-stage amplification circuit is electrically connected with a first end of a third resistor of a previous-stage amplification circuit; and a first end of a third resistor of the current-stage amplification circuit is electrically connected with a control electrode of a first transistor of a next-stage amplification circuit. The first end a1 of the voltage amplification circuit 13 is the control electrode of the first transistor of the first-stage amplification circuit, and the second end a2 of the voltage amplification circuit 13 is the first end of the third resistor of the last-stage amplification circuit, that is, the control electrode of the first transistor of the first-stage amplification circuit is electrically connected with the first node N1, and the first end of the third resistor of the last-stage amplification circuit is electrically connected with the second node N2.

For example, as illustrated in FIG. 3C, the voltage amplification circuit 13 comprises a first-stage amplification circuit 131, a second-stage amplification circuit 131' and a third-stage amplification circuit 131" which are cascaded. For example, the first-stage amplification circuit 131 can receive a data signal and obtain a first amplified voltage signal based on the data signal; the second-stage amplification circuit 131' can receive the first amplified voltage signal and obtain a second amplified voltage signal based on the first amplified voltage signal; and the third-stage amplification circuit 131" can receive the second amplified voltage signal and obtain a third amplified voltage signal based on the second amplified voltage signal. A modulus value of the first amplified voltage signal is larger than a modulus value of the data signal, a modulus value of the second amplified voltage signal is larger than the modulus value of the first amplified voltage signal, and a modulus value of the third amplified voltage signal is larger than the modulus value of the second amplified voltage signal, therefore, compared with the voltage amplification circuits 13 shown in FIG. 3A and FIG. 3B, the voltage amplification circuit 13 shown in FIG. 3C can further increase the voltage written to the control terminal of the light-emitting drive circuit 12.

For example, as illustrated in FIG. 3C, the third-stage amplification circuit 131" is the last-stage amplification circuit. The control electrode of the first transistor T1 of the first-stage amplification circuit 131 is electrically connected to the first node N1, and a first end of a third resistor R3" of the third-stage amplification circuit 131" is electrically connected to the second node N2. The first end of the third resistor R3 of the first-stage amplification circuit 131 is electrically connected with the control electrode of the first transistor T1' of the second-stage amplification circuit 131'; the first end of the third resistor R3' of the second-stage amplification circuit 131' is electrically connected with the control electrode of the first transistor T1" of the third-stage amplification circuit 131".

For example, the first transistor T1, the first transistor T1' and the first transistor T1" can have the same parameters; and the bipolar transistor TA, the bipolar transistor TA', and the bipolar transistor TA" can have the same parameters. The first resistor R1, the first resistor R1' and the first resistor R1" may be the same. The second resistor R2, the second resistor R2' and the second resistor R2" can have the same parameters. The third resistor R3, the third resistor R3' and the third resistor R3" can have the same parameters. The first capacitor C1, the first capacitor C1' and the first capacitor C1" can have the same parameters. That is to say, the corresponding components in amplification circuits of respective stages are the same, thereby simplifying the preparation process. However, the present disclosure is not limited thereto, at least a portion of the corresponding components in the amplification circuits of respective stages may also be different from each other.

For example, a first electrode of a first transistor T1" of the third-stage amplification circuit 131" is electrically connected with the first power terminal Vd1" and a first end of a second resistor R2" of the third-stage amplification circuit 131" is electrically connected with the second power terminal Vd2'. A first power signal output by the first power terminal Vd1" and a second power signal output by the second power terminal Vd2" are not specifically restricted in the present disclosure, as long as the first power signal output by the first power terminal Vd1" is less than the second power signal output by the second power terminal Vd2", and the first power signal output by the first power terminal Vd1" can make the first transistor T1" in a saturated state in the data writing phase, and the second power signal output by the second power terminal Vd2" can make the bipolar transistor TA" in the amplification state.

Figure 4A:
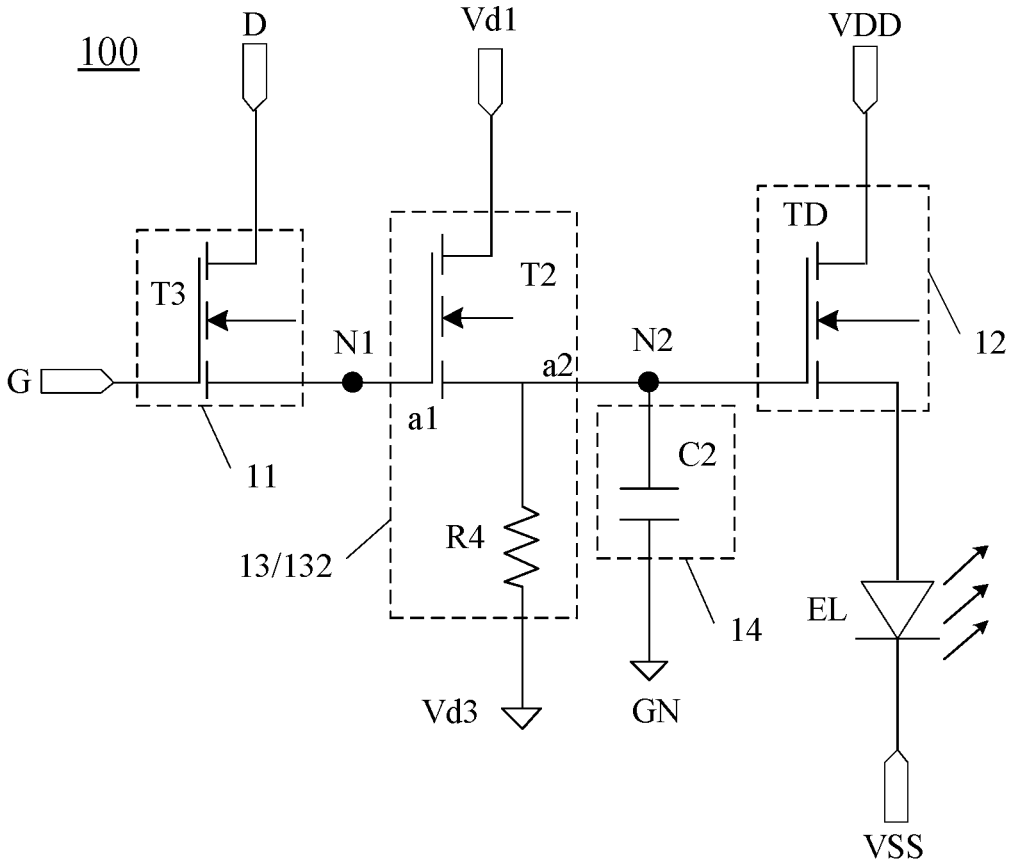
FIG. 4A is a schematic structural diagram of a pixel circuit provided by other embodiments of the present disclosure.

FIG. 4A is a schematic structural diagram of a pixel circuit provided by other embodiments of the present disclosure. For example, as illustrated in FIG. 4A, in the present embodiment, the field effect transistor amplification sub-circuit comprises a second transistor T2 and a fourth resistor R4. A first electrode of the second transistor T2 is electrically connected with the first power terminal Vd1, a second electrode of the second transistor T2 is electrically connected with a first end of the fourth resistor R4, and a second end of the fourth resistor R4 is electrically connected with the third power terminal Vd3.

For example, in the example shown in FIG. 4A, the first power signal output by the first power terminal Vd1 can be set according to an actual situation, as long as the second transistor T2 can be in a saturated state in the data writing phase, which is not limited in the present disclosure.

For example, a resistance value of the fourth resistor R4 can be set according to the actual situation, as long as the modulus value of the voltage written to the second node N2 is greater than the modulus value of the data signal written to the first node N1. As illustrated in FIG. 4A, the third power terminal Vd3 is grounded, and an amplified voltage signal (that is, a voltage signal written into the second node N2) is a voltage drop of the fourth resistor R4. For example, the resistance value of the fourth resistor R4 may be large, according to Ohm's law, in a case where a small current flows through the fourth resistor R4, a large amplified voltage signal can be obtained at the second node N2.

For example, as illustrated in FIG. 4A, the voltage amplification circuit 13 comprises a first-stage amplification circuit 132, and is a single-stage amplification mode. The first-stage amplification circuit 132 comprises a field effect transistor amplification sub-circuit. The first end a1 of the voltage amplification circuit 13 is a control electrode of a second transistor T2 of the first-stage amplification circuit 132, and the second end a2 of the voltage amplification circuit 13 is a second electrode of the second transistor T2 of the first-stage amplification circuit 132, that is, the control electrode of the second transistor T2 of the first-stage amplification circuit 132 is electrically connected with the first node N1, and the second electrode of the second transistor T2 of the first-stage amplification circuit 132 is electrically connected with the second node N2.

For example, in the example shown in FIG. 4A, the amplified voltage signal may be expressed as:

$$V'_{N2}=(\tfrac{1}{2}K_{T2}(V_{data}-V_{thT2})^2)\times r4,$$

in which $V'_{N2}$ is the amplified voltage signal, $K_{T2}$ is a process constant of the second transistor T2, $V_{thT2}$ is a threshold voltage of the second transistor T2, r4 is the resistance value of the fourth resistor R4, and $V_{data}$ is the data signal.

For example, in an example, the process constant $K_{T2}$ of the second transistor T2 may be $8*10^{-4}$, the resistance value r4 of the fourth resistor r4 may be 1000 ohms, the threshold voltage $V_{thT2}$ of the second transistor T2 may be 0.5V, and the data signal $V_{data}$ may be 4V, so that, the amplified voltage signal $V'_{N2}$ can be calculated as:

$$V'_{N2} = (1/2K_{T2}(V_{data}-V_{thT2})^2)\times r4 = (1/2\times 8\times 10^{-4}\times(4-0.5)^2)\times 1000 = 4.9V$$

From the above, the amplified voltage signal $V'_{N2}$ is about 1.225 times as large as an original data signal $V_{data}$. A modulus value of the amplified voltage signal $V_{N2}$ is larger than a modulus value of the original data signal $V_{data}$, that is to say, the voltage at the second node N2 (that is, the voltage at the control terminal of the light-emitting drive circuit 12) is increased.

Figure 4B:
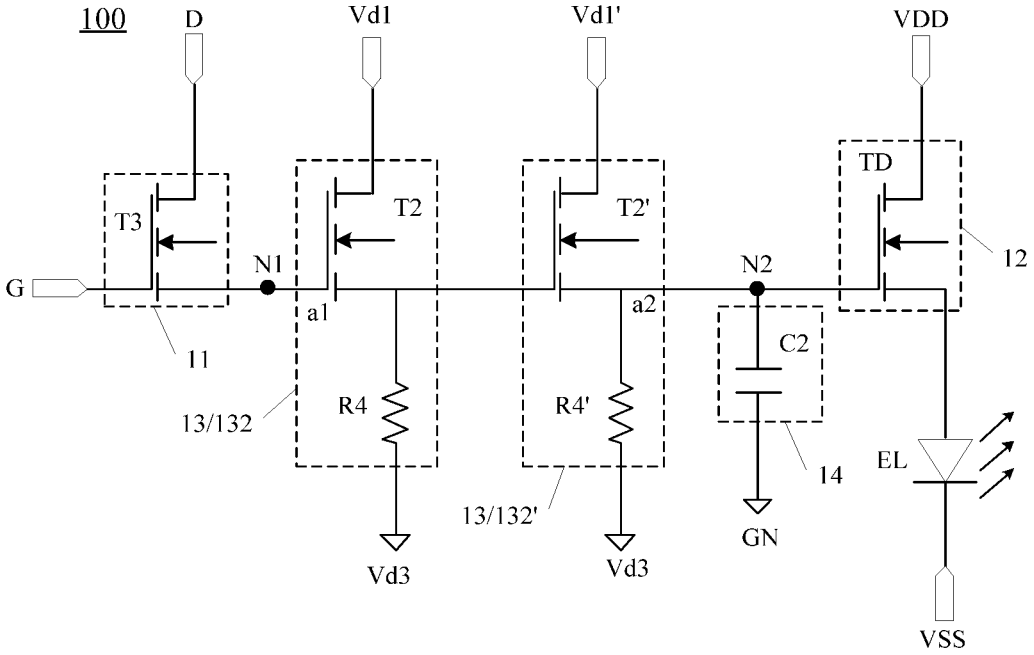
FIG. 4B is a schematic structural diagram of another pixel circuit provided by other embodiments of the present disclosure.

FIG. 4B is a schematic structural diagram of another pixel circuit provided by other embodiments of the present disclosure. For example, as illustrated in FIG. 4B, the voltage amplification circuit 13 comprises a first-stage amplification circuit 132 and a second-stage amplification circuit 132' which are cascaded, and is a multi-stage amplification mode. The first-stage amplification circuit 132 and the second-stage amplification circuit 132' each comprises the field effect transistor amplification sub-circuit. For example, the first-stage amplification circuit 132 may receive a data signal and obtain a first amplified voltage signal based on the data signal. The second-stage amplification circuit 132' may receive the first amplified voltage signal and obtain a second amplified voltage signal based on the first amplified voltage signal, in which a modulus value of the first amplified voltage signal is larger than a modulus value of the data signal, and a modulus value of the second amplified voltage signal is larger than the modulus value of the first amplified voltage signal, and thus, compared with the voltage amplification circuit 13 shown in FIG. 4A, the voltage amplification circuit 13 shown in FIG. 4B can further increase the voltage written to the control terminal of the light-emitting drive circuit 12.

For example, as illustrated in FIG. 4B, the first end a1 of the voltage amplification circuit 13 is a control electrode of a second transistor T2 of the first-stage amplification circuit 132, and the second end a2 of the voltage amplification circuit 13 is a second electrode of a second transistor T2' of the second-stage amplification circuit 132', that is, the control electrode of the second transistor T2 of the first-stage amplification circuit 132 is electrically connected with the first node N1, and the second electrode of the second transistor T2' of the second-stage amplification circuit 132' is electrically connected with the second node. A second electrode of the second transistor T2 of the first-stage amplification circuit 132 is electrically connected with a control electrode of the second transistor T2' of the second-stage amplification circuit 132'.

For example, the second transistor T2 and the fourth resistor R4 of the first-stage amplification circuit 132 are the same as the second transistor T2' and the fourth resistor R4' of the second-stage amplification circuit 132', respectively. The present disclosure is not limited thereto, the second transistor T2 and the second transistor T2' may also be different from each other, and the fourth resistor R4 and the fourth resistor R4' may also be different from each other.

For example, a first electrode of the second transistor T2 of the first-stage amplification circuit 132 is electrically connected with the first power terminal Vd1, and a first electrode of the second transistor T2' of the second-stage amplification circuit 132' is electrically connected with the first power terminal Vd1'. The first power signal output by the first power terminal Vd1 and the first power signal output by the first power terminal Vd1' are not specifically restricted in the present disclosure, as long as the first power signal output by the first power terminal Vd1 can ensure that the second transistor T2 is in a saturated state in the data writing phase, and the first power signal output by the first power terminal Vd1' can ensure that the second transistor T2' is in a saturated state in the data writing phase.

Figure 4C:
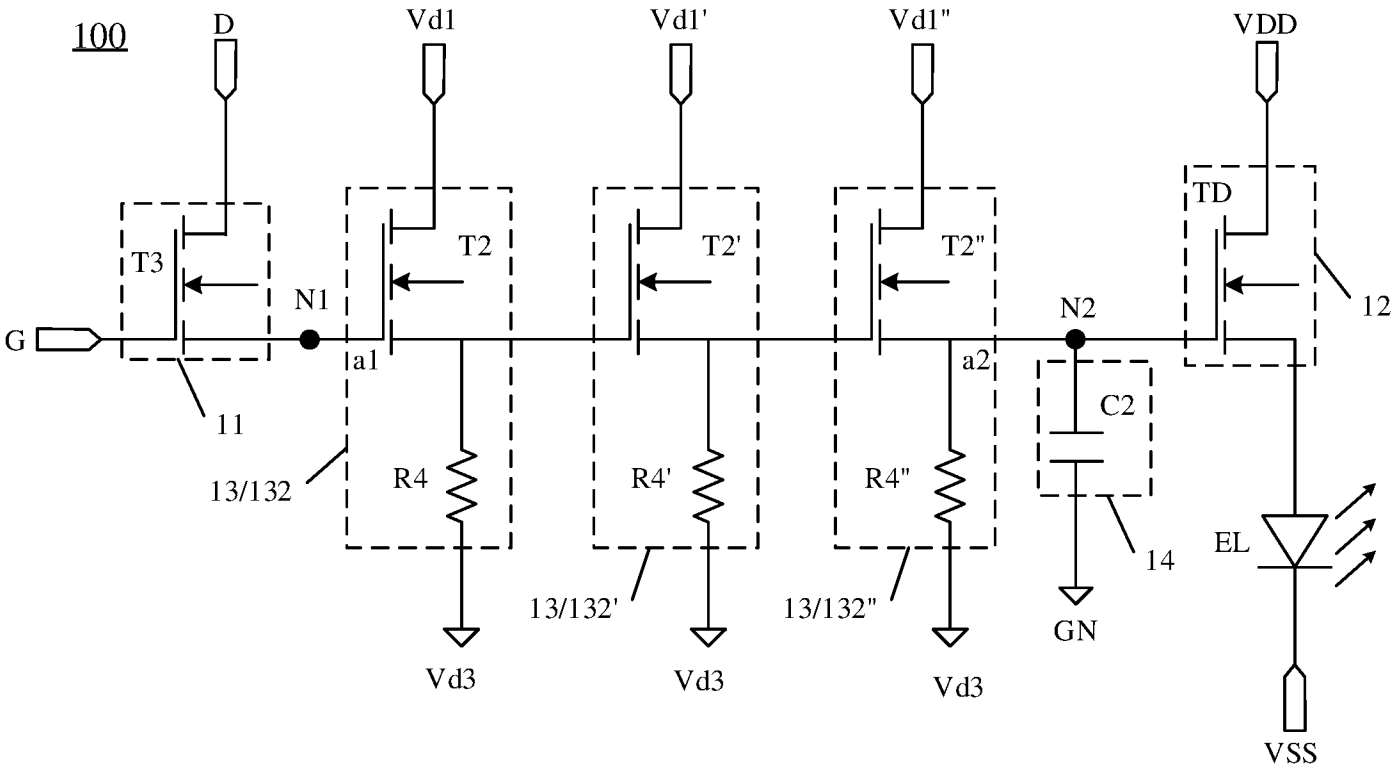
FIG. 4C is a schematic structural diagram of still another pixel circuit provided by other embodiments of the present disclosure.

FIG. 4C is a schematic structural diagram of still another pixel circuit provided by other embodiments of the present disclosure. The voltage amplification circuit 13 comprises a plurality of amplification circuits which are cascaded, each of the plurality of amplification circuits comprises the field effect transistor amplification sub-circuit. In addition to a first-stage amplification circuit and a last-stage amplification circuit, a control electrode of a second transistor of a current-stage amplification circuit is electrically connected with a second electrode of a second transistor of a previous-stage amplification circuit; and a second electrode of the second transistor of the current-stage amplification circuit is electrically connected with a control electrode of a second transistor of a next-stage amplification circuit. The first end a1 of the voltage amplification circuit 13 is a control electrode of a second transistor of the first-stage amplification circuit, and the second end a2 of the voltage amplification circuit 13 is a second electrode of a second transistor of the last-stage amplification circuit, that is, the control electrode of the second transistor of the first-stage amplification circuit is electrically connected with the first node N1, and the second electrode of the second transistor of the last-stage amplification circuit is electrically connected with the second node N2.

For example, as illustrated in FIG. 4C, the voltage amplification circuit 13 comprises a first-stage amplification circuit 132, a second-stage amplification circuit 132' and a third-stage amplification circuit 132" which are cascaded. For example, the first-stage amplification circuit 132 may receive a data signal and obtain a first amplified voltage signal based on the data signal. The second-stage amplification circuit 132' may receive the first amplified voltage signal and obtain a second amplified voltage signal based on the first amplified voltage signal; the third-stage amplification circuit 132" may receive the second amplified voltage signal and obtain a third amplified voltage signal based on the second amplified voltage signal. A modulus value of the first amplified voltage signal is larger than a modulus value of the data signal, a modulus value of the second amplified voltage signal is larger than the modulus value of the first amplified voltage signal, and a modulus value of the third amplified voltage signal is larger than the modulus value of the second amplified voltage signal, and compared with the voltage amplification circuits 13 shown in FIG. 4A and FIG. 4B, the voltage amplification circuit 13 shown in FIG. 4C can further increase the voltage written to the control terminal of the light-emitting drive circuit 12.

For example, as illustrated in FIG. 4C, the third-stage amplification circuit 132" is the last-stage amplification circuit. A control electrode of a second transistor T2 of the first-stage amplification circuit 132 is electrically connected with the first node N1, and a second electrode of a second transistor T2" of the third-stage amplification circuit 132" is electrically connected with the second node N2. A second electrode of the second transistor T2 of the first-stage amplification circuit 132 is electrically connected with a control electrode of a second transistor T2' of the second-stage amplification circuit 132'; and a second electrode of the second transistor T2' of the second-stage amplification circuit 132' is electrically connected with a control electrode of the second transistor T2" of the third-stage amplification circuit 132".

For example, a first electrode of the second transistor T2" in the third-stage amplification circuit 132" is electrically connected with the first power terminal Vd1". The first power signal output from the first power terminal Vd1" is not specifically restricted in the present disclosure, as long as the first power signal output from the first power terminal Vd1" can ensure that the second transistor T2" is in a saturated state in the data writing phase.

For example, in the voltage amplification circuit 13, the corresponding components in amplification circuits of respective stages are the same, and thus the preparation process is simplified. However, the present disclosure is not limited thereto, at least a portion of the corresponding components in the amplification circuits of respective stages may also be different from each other.

It should be noted that, in the above-mentioned embodiments of the present disclosure, the number, the type and the like of the plurality of amplification circuits in the voltage amplification circuit 13 may be set according to the actual situation, and the present disclosure is not limited thereto.

For example, as illustrated in FIG. 4A to FIG. 4C, all the transistors in the pixel circuit 100 may be N-type transistors (for example, NMOS) or P-type transistors (for example, PMOS), so that the transistors in the pixel circuit may be uniformly fabricated by using an NMOS process or a PMOS process, and a semiconductor process doping process can be easily achieved.

Figure 5A:
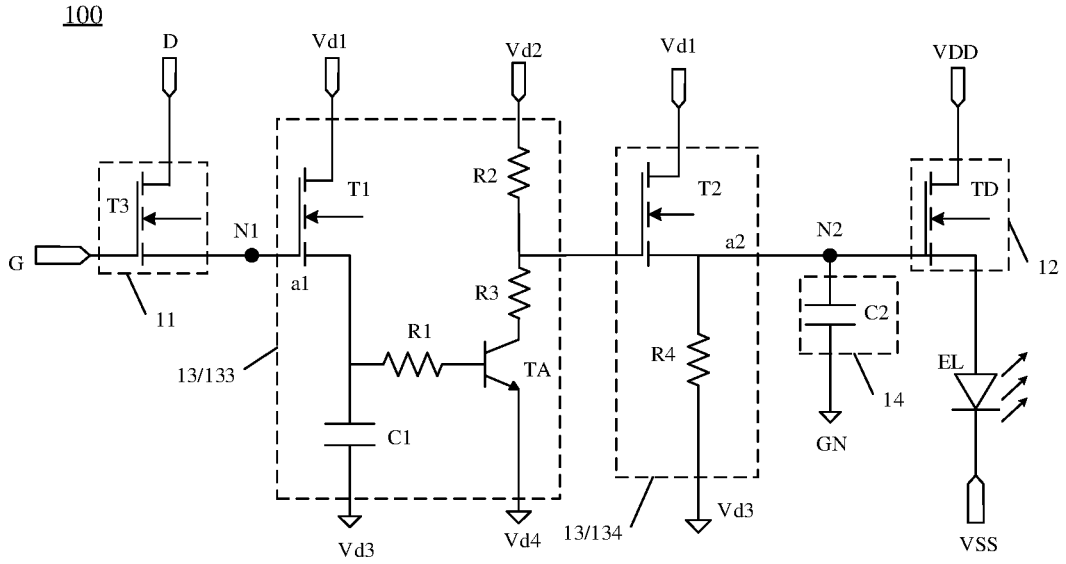
FIG. 5A is a schematic structural diagram of a pixel circuit provided by still other embodiments of the present disclosure.
Figure 5B:
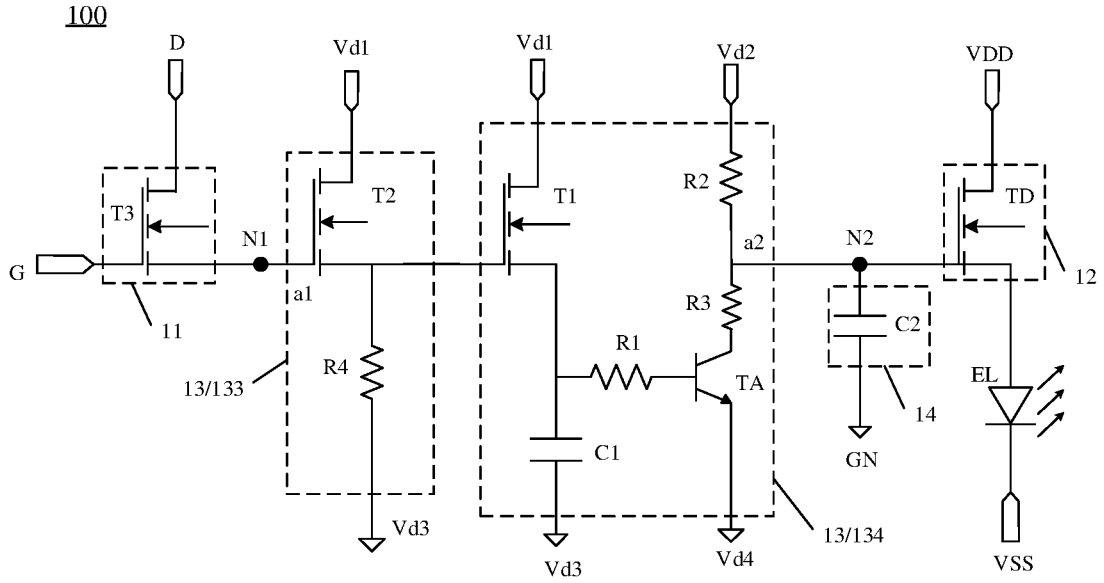
FIG. 5B is a schematic structural diagram of another pixel circuit provided by still other embodiments of the present disclosure.

FIG. 5A is a schematic structural diagram of a pixel circuit provided by still other embodiments of the present disclosure, and FIG. 5B is a schematic structural diagram of another pixel circuit provided by still other embodiments of the present disclosure. For example, in some embodiments, the voltage amplification circuit 13 can comprise both the field effect transistor amplification sub-circuit and the bipolar transistor amplification sub-circuit.

For example, as illustrated in FIG. 5A, in some embodiments, the voltage amplification circuit 13 may comprise a first-stage amplification circuit 133 and a second-stage amplification circuit 134 which are cascaded, the first-stage amplification circuit 133 comprises the bipolar transistor amplification sub-circuit, and the second-stage amplification circuit 134 comprises the field effect transistor amplification sub-circuit. A control electrode of a first transistor T1 of the first-stage amplification circuit 133 is electrically connected with the first node N1, a first end of a third resistor R3 of the first-stage amplification circuit 133 is electrically connected with a control electrode of a second transistor T2 of the second-stage amplification circuit 134, and a second electrode of the second transistor T2 of the second-stage amplification circuit 134 is electrically connected with the second node N2.

For example, as illustrated in FIG. 5B, in other embodiments, the voltage amplification circuit 13 may comprise a first-stage amplification circuit 133 and a second-stage amplification circuit 134 which are cascaded, the first-stage amplification circuit 133 comprises the field effect transistor amplification sub-circuit, and the second-stage amplification circuit 134 comprises the bipolar transistor amplification sub-circuit. A control electrode of a second transistor T2 of the first-stage amplification circuit 133 is electrically connected with the first node N1, a second electrode of the second transistor T2 of the first-stage amplification circuit 133 is electrically connected with a control electrode of a first transistor T1 of the second-stage amplification circuit 134, and a first end of a third resistor R3 of the second-stage amplification circuit 134 is electrically connected with the second node N2.

It should be noted that, a cascading manner of the field effect transistor amplification sub-circuit and the bipolar transistor amplification sub-circuit may be designed according to specific situations, which is not limited in the present disclosure.

For example, as illustrated in FIGS. 3A to 3C, 4A to 4C and 5A to 5B, the light-emitting drive circuit 12 comprises a light-emitting drive transistor TD. A first electrode of the light-emitting drive transistor TD is electrically connected with a first drive power terminal VDD, a second electrode of the light-emitting drive transistor TD is electrically connected with a first end of the light-emitting component EL (in this embodiment, a positive electrode of the light-emitting component EL), and a control electrode of the light-emitting drive transistor TD is electrically connected with the second node N2. A second end of the light-emitting component EL (in this embodiment, a negative electrode of the light-emitting component EL) is electrically connected with a second drive power terminal VSS.

For example, the light-emitting component EL may be a light-emitting diode, etc. The light-emitting diode may be an organic light-emitting diode (OLED), a quantum dot light-emitting diode (QLED), or the like. The light-emitting component EL is configured to receive a light-emitting signal (for example, a driving current) while working and emit light with an intensity corresponding to the light-emitting signal.

For example, the first drive power terminal VDD is a voltage source to output a constant positive voltage; the second drive power terminal VSS is configured to apply a variable voltage, for example, an AC pulse signal, to the second end of the light-emitting component EL. For example, in the data writing phase, the second drive power terminal VSS is configured to apply a high level signal to the second end of the light-emitting component EL, so that the light-emitting component EL is prevented from emitting at this phase, which results in a decrease in contrast of the display panel; in the light-emitting phase, the second drive power terminal VSS is configured to apply a low level signal to the second end of the light-emitting component EL.

For example, as illustrated in FIGS. 3A to 3C, 4A to 4C and 5A to 5B, the data writing circuit 11 comprises a data writing transistor T3. A first electrode of the data writing transistor T3 is electrically connected with the data line D to receive a data signal, a second electrode of the data writing transistor T3 is electrically connected with the first node N1, and a control electrode of the data writing transistor T3 is electrically connected with a scan signal line G to receive a scan signal. For example, in the example shown in FIG. 3A, the data writing transistor T3 can write the data signal to the first node N1, because the control electrode of the first transistor T1 of the first-stage amplification circuit 131 is electrically connected with the first node N1, so that the data signal can be written to the control electrode of the first transistor T1 of the first-stage amplification circuit 131.

For example, as illustrated in FIGS. 3A to 3C, 4A to 4C and 5A to 5B, the pixel circuit 100 further comprises a storage circuit 14. The storage circuit 14 is configured to store an amplified voltage signal. The storage circuit 14 comprises a second capacitor C2. A first end of the second capacitor C2 is electrically connected with the second node N2, and a second end of the second capacitor C2 is grounded or electrically connected with the first drive power terminal VDD. In the examples shown in FIGS. 3A to 3C, 4A to 4C and 5A to 5B, the second end of the second capacitor C2 is grounded, that is, the second end of the second capacitor C2 is electrically connected with the ground GN.

Figure 6:
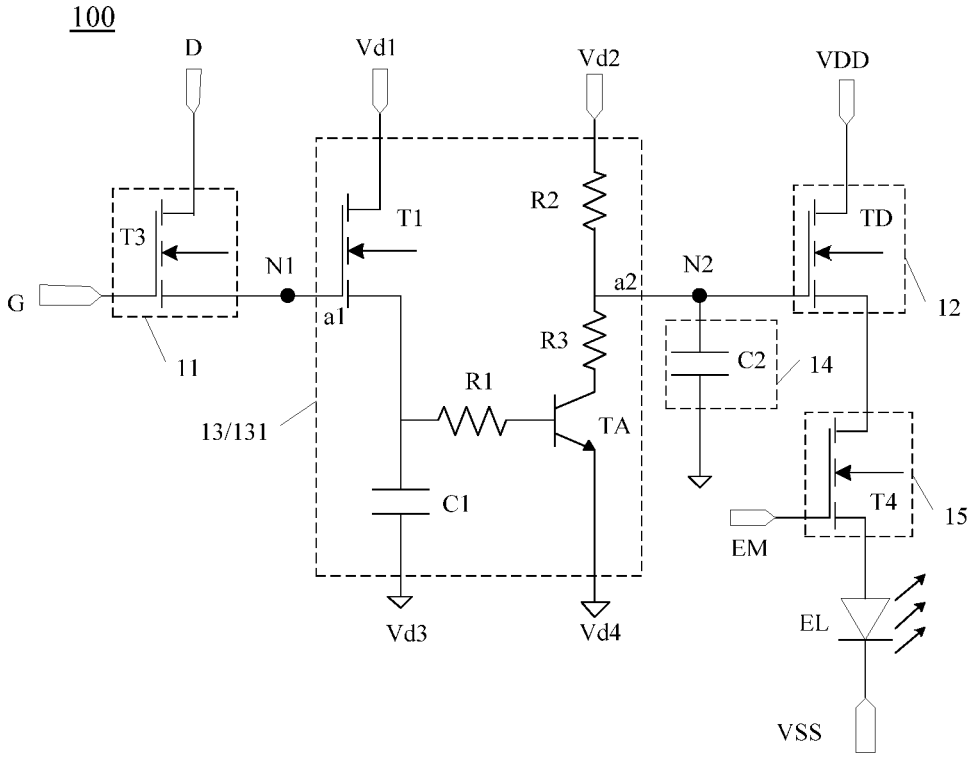
FIG. 6 is a schematic structural diagram of a pixel circuit provided by yet other embodiments of the present disclosure.

FIG. 6 is a schematic structural diagram of a pixel circuit provided by still other embodiments of the present disclosure. For example, the pixel circuit 100 further comprises a light-emitting control circuit 15. As illustrated in FIG. 6, the light-emitting control circuit 15 is configured to control a driving current of the light-emitting drive circuit 12 under control of a light-emitting control signal, so as to avoid that, for example, the light-emitting component EL is driven to emit light in the data writing phase. In this case, for example, the second drive power terminal VSS may be a voltage source to output a constant negative voltage.

For example, as illustrated in FIG. 6, the light-emitting control circuit 15 may comprise a light-emitting control transistor T4. A control electrode of the light-emitting control transistor T4 is electrically connected with a light-emitting control line EM to receive the light-emitting control signal, a first electrode of the light-emitting control transistor T4 is electrically connected with the light-emitting drive circuit 12 (for example, a second electrode of the light-emitting drive transistor TD), and a second electrode of the light-emitting control transistor T4 is electrically connected with the first end of the light-emitting component EL.

It should be noted that, the data writing circuit 11, the light-emitting drive circuit 12, the storage circuit 14 and the light-emitting control circuit 15 are not limited to the structures described in the above-mentioned embodiments, and their specific structures may be set according to practical application requirements, and are not specifically limited by the embodiments of the present disclosure. In other embodiments of the present disclosure, the pixel circuit 100 may further comprise a transfer transistor, a compensation transistor, a detection transistor or a reset transistor, etc., as needed. For example, according to practical application requirements, in other embodiments of the present disclosure, the pixel circuit 100 can also have an electrical compensation function to compensate for a threshold voltage drift of the light-emitting drive transistor and enhance the display uniformity of a display panel. For example, the compensation function can be implemented by a voltage compensation, a current compensation or a hybrid compensation, and a compensation method can be an internal compensation method or an external compensation method.

At least one embodiment of the present disclosure further provides a driving method of a pixel circuit, and the driving method may be applied to any one of the pixel circuits described above.

Figure 7:
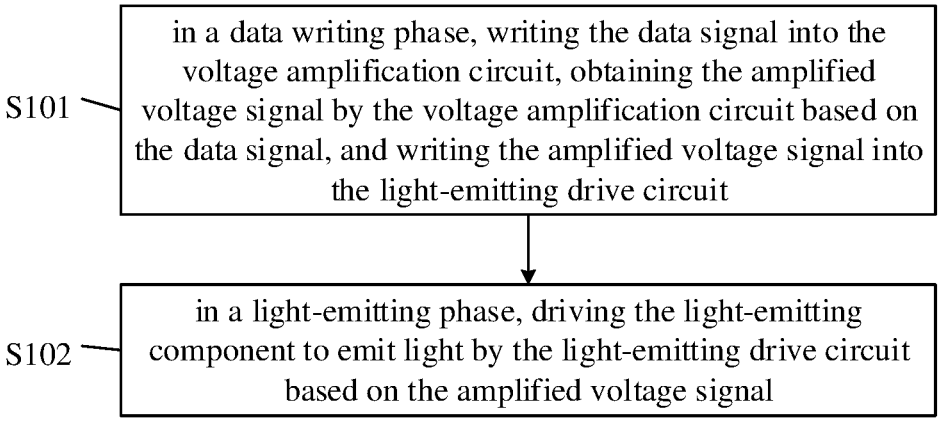
FIG. 7 is a schematic flow chart of a driving method of a pixel circuit provided by some embodiments of the present disclosure.

FIG. 7 is a schematic flow chart of a driving method of a pixel circuit provided by some embodiments of the present disclosure. As illustrated in FIG. 7, the driving method of the pixel circuit may comprise the following steps:

Step S101: in a data writing phase, writing the data signal into the voltage amplification circuit, obtaining the amplified voltage signal by the voltage amplification circuit based on the data signal, and writing the amplified voltage signal into the light-emitting drive circuit;

Step S102: in a light-emitting phase, driving the light-emitting component to emit light by the light-emitting drive circuit based on the amplified voltage signal.

For example, in the embodiment shown in FIG. 3A, the voltage amplification circuit 13 comprises the first-stage amplification circuit 131, and the first-stage amplification circuit 131 comprises the bipolar transistor amplification sub-circuit. The bipolar transistor amplification sub-circuit comprises the first transistor T1 and the bipolar transistor TA. Therefore, in the Step S101, obtaining the amplified voltage signal by the voltage amplification circuit based on the data signal comprises: writing the data signal to a control electrode of the first transistor, and controlling the first transistor to be in a saturated state to obtain a saturation current; controlling the bipolar transistor to be in an amplification state, and amplifying the saturation current by the bipolar transistor to obtain an amplified current, and obtaining the amplified voltage signal based on the amplified current.

Figure 8:
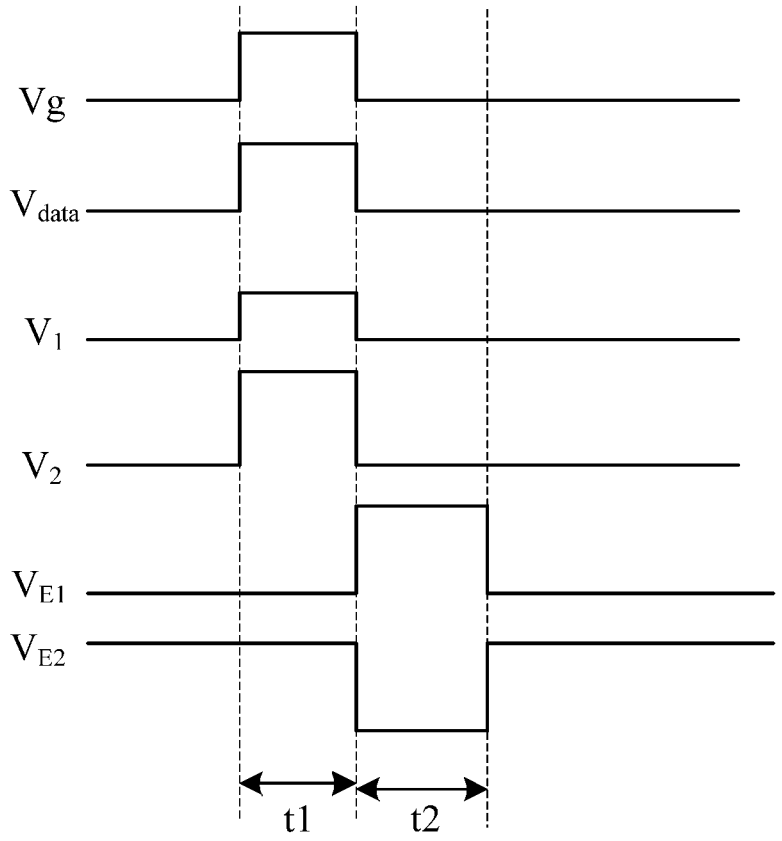
FIG. 8 is an exemplary timing chart of a driving method of the pixel circuit illustrated in FIG. 3A.

For example, in an example, FIG. 8 is an exemplary timing chart of a driving method of the pixel circuit illustrated in FIG. 3A. An operation flow of a driving method of the pixel circuit provided in the embodiment of the present disclosure is described in detail below with reference to FIG. 3A and FIG. 8.

For example, as illustrated in FIG. 3A and FIG. 8, in the data writing phase t1, a scan signal Vg provided by a scan signal line G is a high level signal, and the scan signal Vg is transmitted to a control electrode of a data writing transistor T3, so that the data writing transistor T3 is turned on. In this situation, a data line D provides a data signal $V_{data}$ to a first electrode of the data writing transistor T3. The data signal $V_{data}$ can be set according to the actual situation, for example, the data signal $V_{data}$ may be a high level signal. The data signal $V_{data}$ is transmitted to the control electrode of the first transistor T1 of the first-stage amplification circuit 131 through the data writing transistor T3. Meanwhile, a first power signal $V_1$ provided by the first power terminal Vd1 is a high level signal, and the first power signal $V_1$ is transmitted to the first electrode of the first transistor T1 of the first-stage amplification circuit 131. The first power signal $V_1$ and the data signal $V_{data}$ can control the first transistor T1 of the first-stage amplification circuit 131 to be in a saturated state, that is, in a turn-on state. According to a saturation current formula of the first transistor T1, the saturation current $I_{T1}$ of the first transistor T1 can be expressed as:

$$I_{T1}=\tfrac{1}{2}K_{T1}(V_{data}-V_{thT1})^2,$$

where, $K_{T1}$ is a process constant of the first transistor T1 and $V_{thT1}$ is a threshold voltage of the first transistor T1. The saturation current $I_{T1}$ is a current flowing through the first resistor R1.

For example, $K_{T1}$ may be expressed as:

$$K_{T1}=0.5\mu_{nT1}\times C_{oxT1}\times(W_{T1}/L_{T1}),$$

in which $\mu_{nT1}$ is an electron mobility of the first transistor T1, $C_{oxT1}$ is a gate unit capacitance of the first transistor T1, $W_{T1}$ is a channel width of the first transistor T1, and $L_{T1}$ is a channel length of the first transistor T1.

For example, in the data writing phase t1, the saturation current $I_{T1}$ can flow through the first transistor T1, the first resistor R1 and the bipolar transistor TA sequentially, and finally flow to the fourth power terminal Vd4. In the case where the charging of the first capacitor C1 is completed, a voltage signal $U_1$ on the first end of the first resistor R1 can be expressed as:

$$U_1=I_{T1}\times r1+\mathrm{Ube},$$

in which r1 is a resistance value of the first resistor R1 and Ube is a constant related to the bipolar transistor TA.

For example, in the data writing phase t1, during the charging process of the first capacitor C1, the second power terminal Vd2 can provide a second power signal V2, and the second power signal V2 is a high level signal, so that the bipolar transistor TA is in an amplification state. The bipolar transistor TA can amplify the current (namely, the saturation current $I_{T1}$) flowing through the first resistor R1 to obtain an amplified current. The amplified current is a current flowing through the third resistor R3. The amplified current can be expressed as:

$$I_{N2}=\beta\times I_{T1},$$

in which $I_{N2}$ is the amplified current, and β is an amplification factor of the bipolar transistor TA, for example, β may be 100 or 200 or the like. That is to say, the bipolar transistor TA can amplify the current flowing through the first resistor R1 by a factor of β. At this time, the voltage signal (namely, the amplified voltage signal) on the second node N2 is:

$$V_{N2}=\beta\times I_{T1}\times r3,$$

in which $V_{N2}$ is the amplified voltage signal and r2 is a resistance value of the second resistor R2. The amplified voltage signal is a voltage drop of the third resistor R3.

For example, as illustrated in FIG. 8, the first power signal $V_1$ is smaller than the second power signal $V_2$. The second power signal $V_2$ can be set according to the actual situation. The second power signal $V_2$ can be large to ensure that the bipolar transistor TA is in an amplification state.

For example, in the data writing phase t1, a first drive power signal $V_{E1}$ provided by the first drive power terminal VDD is a low level signal, and a second drive power signal $V_{E2}$ provided by the second drive power terminal VSS is a high level signal, thereby ensuring that the light-emitting component EL does not emit light in the data writing phase t1.

For example, as illustrated in FIG. 3A and FIG. 8, in the light-emitting phase t2, the amplified voltage signal $V_{N2}$ controls the light-emitting drive transistor TD to be turned on. The first drive power signal $V_{E1}$ provided by the first drive power terminal VDD is a high level signal, and the second drive power signal $V_{E2}$ provided by the second drive power terminal VSS is a low level signal. The first drive power signal $V_{E1}$ is transmitted to the first electrode of the light-emitting drive transistor TD, and the second drive power signal $V_{E2}$ is transmitted to the second end of the light-emitting component EL. The light-emitting drive transistor TD is in a saturated state, so that based on a saturation current formula of the light-emitting drive transistor TD, the driving current $I_{oled}$ flowing through the light-emitting drive transistor TD can be expressed as:

$$I_{oled} = 1/2K_{TD} \times (V_{N2} - V_{thTD})^2 = 1/2K_{TD} \times (\beta \times (1/2K_{T1}(V_{data} - V_{thT1})^2) \times r3 - V_{thTD})^2$$

in which $K_{TD}$ is a process constant of the light-emitting drive transistor TD, and $V_{thTD}$ is a threshold voltage of the light-emitting drive transistor TD. For example, $K_{TD}$ may be expressed as:

$$K_{TD} = 0.5\mu_{nTD} \times C_{oxTD} \times (W_{TD}/L_{TD})$$

in which $\mu_{nTD}$ is an electron mobility of the light-emitting drive transistor TD, $C_{oxTD}$ is a gate unit capacitance of the light-emitting drive transistor TD, $W_{TD}$ is a channel width of the light-emitting drive transistor TD, and $L_{TD}$ is a channel length of the light-emitting drive transistor TD.

According to the above formula of the driving current $I_{oled}$, the driving current $I_{oled}$ is proportional to a voltage of the control electrode (namely, the amplified voltage signal $V_{N2}$) of the light-emitting drive transistor TD, and a modulus value of the amplified voltage signal $V_{N2}$ is larger than a modulus value of the data signal $V_{data}$. Thus, the pixel circuit can increase the driving current for driving the light-emitting component to emit light, improve the luminous brightness of the light-emitting component and improve the display effect.

For example, in the embodiment shown in FIG. 4A, the voltage amplification circuit 13 comprises the first-stage amplification circuit 132, and the first-stage amplification circuit 132 comprises the field effect transistor amplification sub-circuit. The field effect transistor amplification sub-circuit comprises the second transistor T2 and the fourth resistor R4. Therefore, in the step S101, obtaining the amplified voltage signal by the voltage amplification circuit based on the data signal comprises: writing the data signal to a control electrode of the second transistor, and controlling the second transistor to be in a saturated state to obtain a saturation current; and obtaining the amplified voltage signal based on the saturation current and the fourth resistor.

Figure 9:
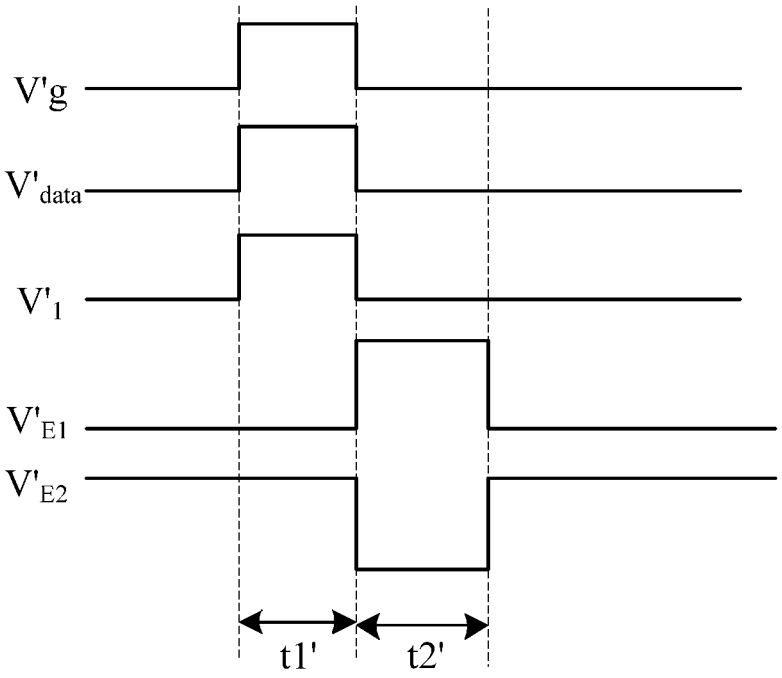
FIG. 9 is an exemplary timing chart of a driving method of the pixel circuit illustrated in FIG. 4A.

For example, in another example, FIG. 9 is an exemplary timing chart of a driving method of the pixel circuit illustrated in FIG. 4A. An operation flow of another driving method of the pixel circuit provided in the embodiment of the present disclosure is described in detail below with reference to FIG. 4A and FIG. 9.

For example, as illustrated in FIG. 4A and FIG. 9, in the data writing phase t1', a scan signal V'g provided by a scan signal line G is a high level signal, and the scan signal V'g is transmitted a control electrode of the data writing transistor T3, so that the data writing transistor T3 is turned on. In this situation, a data line D provides a data signal $V'_{data}$ to the first electrode of the data writing transistor T3. The data signal $V'_{data}$ can be set according to the actual situation, for example, the data signal $V'_{data}$ can be a high level signal. The data writing transistor T3 transmits the data signal $V'_{data}$ to the control electrode of the second transistor T2 of the first-stage amplification circuit 132. Meanwhile, the first power signal $V'_1$ provided by the first power terminal Vd1 is a high level signal, and the first power signal $V'_1$ is transmitted to the first electrode of the second transistor T2 of the first-stage amplification circuit 132. The first power signal $V'_1$ and the data signal $V'_{data}$ can control the second transistor T2 of the first-stage amplification circuit 132 to be in a saturated state, that is, in a turn-on state. According to a saturation current formula of the second transistor T2, the saturation current $I_{T2}$ of the second transistor T2 can be expressed as:

$$I_{T2} = \tfrac{1}{2}K_{T2}(V_{data} - V_{thT2})^2,$$

in which $K_{T2}$ is a process constant of the second transistor T2 and $V_{thT2}$ is a threshold voltage of the second transistor T2. For example, $K_{T2}$ may be expressed as:

$$K_{T2} = 0.5\mu_{nT2} \times C_{oxT2} \times (W_{T2}/L_{T2})$$

in which $\mu_{nT2}$ is an electron mobility of the second transistor T2, $C_{oxT2}$ is a gate unit capacitance of the second transistor T2, $W_{T2}$ is a channel width of the second transistor T2, and $L_{T2}$ is a channel length of the second transistor T2.

For example, in the data writing phase t1', the saturation current $I_{T2}$ can flow through the second transistor T2 and the fourth resistor R4 sequentially, and finally flow to the third power terminal Vd3. At this time, the voltage signal (namely, the amplified voltage signal) on the second node N2 is:

$$V'_{N2} = I_{T2} \times r4,$$

in which $V'_{N2}$ is the amplified voltage signal and r4 is a resistance value of the fourth resistor R4. The resistance value r4 of the fourth resistor R4 may be set according to the actual situation, so as to ensure that a modulus value of the amplified voltage signal $V'_{N2}$ is larger than a modulus value of the data signal $V'_{data}$.

For example, in the data writing phase t1', a first drive power signal $V'_{E1}$ provided by the first drive power terminal VDD is a low level signal, and a second drive power signal $V'_{E2}$ provided by the second drive power terminal VSS is a high level signal, thereby ensuring that the light-emitting component EL does not emit light in the data writing phase t1'.

For example, as illustrated in FIG. 4A and FIG. 9, in the light-emitting phase t2', the amplified voltage signal $V'_{N2}$ controls the light-emitting drive transistor TD to be turned on. The first drive power terminal VDD provides the first drive power signal $V'_{E1}$ for the first electrode of the light-emitting drive transistor TD, the first drive power signal $V'_{E1}$ is a high level signal, the second drive power terminal VSS provides the second drive power signal $V'_{E2}$ for the second end of the light-emitting component, and the second drive power signal $V'_{E2}$ is a low level signal. The light-emitting drive transistor TD can be in a saturated state, based on a saturation current formula of the light-emitting drive transistor TD, the driving current $I'_{oled}$ flowing through the light-emitting drive transistor TD can be expressed as:

$$I'_{oled} = 1/2K_{TD} \times (V'_{N2} - V_{thTD})^2 = 1/2K_{TD} \times (1/2K_{T2}(V_{data} - V_{thT2})^2 \times r4 - V_{thTD})^2$$

in which $K_{TD}$ is a process constant of the light-emitting drive transistor TD, and $V_{thTD}$ is a threshold voltage of the light-emitting drive transistor TD.

For example, $K_{TD}$ may be expressed as: $K_{TD}=0.5\mu_{nTD}\times C_{oxTD}\times(W_{TD}/L_{TD})$, in which $\mu_{nTD}$ is an electron mobility of the light-emitting drive transistor TD, $C_{oxTD}$ is a gate unit capacitance of the light-emitting drive transistor TD, $W_{TD}$ is a channel width of the light-emitting drive transistor TD, and $L_{TD}$ is a channel length of the light-emitting drive transistor TD.

For example, due to a storage function of the second capacitor C2, a modulus value of the amplified voltage signal $V'_{N2}$ is greater than a modulus value of the data signal $V_{data}$ in one frame time, thereby increasing the voltage of the control electrode of the light-emitting drive transistor, increasing the driving current for driving the light-emitting component to emit light, improving the luminous brightness of the light-emitting component, and improving the display effect.

It should be noted that, the timing charts of the pixel circuit can be set according to actual requirements, which is not specifically limited in the embodiments of the present disclosure.

Figure 10:
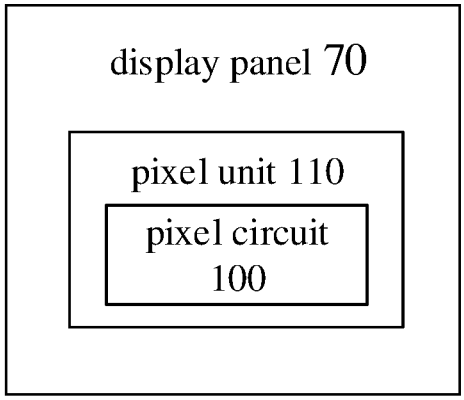
FIG. 10 is a schematic block diagram of a display panel provided by some embodiments of the present disclosure.

At least one embodiment of the present disclosure further provides a display panel. FIG. 10 is a schematic block diagram of a display panel provided by some embodiments of the present disclosure. As illustrated in FIG. 10, the display panel 70 comprises a plurality of pixel units 110, and the plurality of the pixel units 110 are arranged in an array on a silicon substrate. Each of the pixel units 110 may comprise the pixel circuit 100 described in any one of the above embodiments. The pixel circuit can increase the voltage of the control terminal of the light-emitting drive circuit, so that the driving current for driving the light-emitting component to emit light is increased and the brightness of the display panel is improved.

For example, the display panel 70 may be a rectangular panel, a circular panel, an elliptical panel or a polygonal panel and so on. In addition, the display panel 70 can not only be a flat panel, but also a curved panel, or even a spherical panel.

For example, the display panel 70 may further comprise a touch sensor (for example, an on-cell type or an in-cell type) to have a touch control function, that is, the display panel 70 may be a touch display panel.

Figure 11:
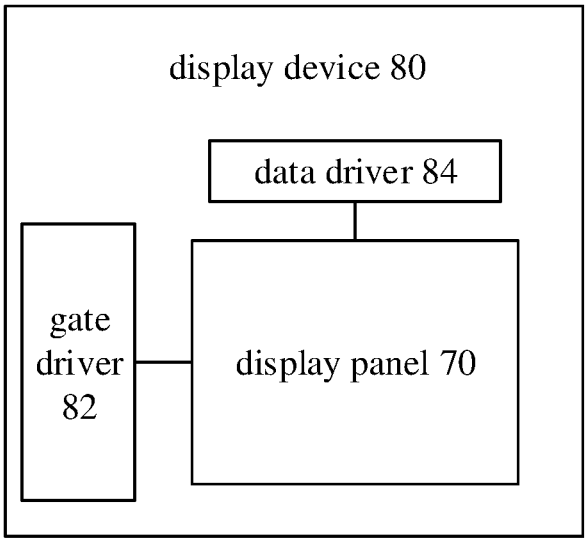
FIG. 11 is a schematic block diagram of a display device provided by some embodiments of the present disclosure.

An embodiment of the present disclosure further provides a display device. FIG. 11 is a schematic block diagram of a display device provided by some embodiments of the present disclosure. As illustrated in FIG. 11, the display device 80 comprises any one of the display panels 70 mentioned above, and the display panel 70 is used for displaying images.

For example, the display device 80 may further comprise a gate driver 82. The gate driver 82 is configured to be electrically connected with a data writing circuit of the pixel circuit in the pixel unit through a scan signal line, so as to provide a scan signal for the data writing circuit.

For example, the display device 80 may further comprise a data driver 84. The data driver 84 is configured to be electrically connected with the data writing circuit of the pixel circuit in the pixel unit through a data line, so as to provide a data signal for the data writing circuit.

For example, the display device 80 may be any product or component having a display function such as a mobile phone, a tablet computer, a TV, a display, a notebook computer, a digital photo frame, a navigator, and so on.

It should be noted that, other components of the display device 80 (for example, a control device, an image data encoding or decoding device, a clock circuit and so on) should be understood to be included by those skilled in the art, and are omitted herein, and should not be construed as limiting the present disclosure.

For the present disclosure, the following points need to be explained:

(1) The accompanying drawings of the embodiments of the present disclosure only involve the structures related to the embodiments of the present disclosure, and other structures can be referred to general designs.

(2) For clarity, in the accompanying drawings for describing the embodiments of the present disclosure, a thickness and size of a layer or a structure may be exaggerated. However, it should be understood that: in a case where an element such as a layer, a film, a region or a substrate or the like is referred to be disposed "on" or "beneath" another element, the element may be "directly" disposed "on" or "beneath" another element, or an intermediate element may be interposed therebetween.

(3) In case of no conflict, the embodiments of the present disclosure and the features in the embodiments can be combined with each other to obtain new embodiments.

What have been described above are only specific implementations of the present disclosure, the protection scope of the present disclosure is not limited thereto, and the protection scope of the present disclosure should be based on the protection scope of the claims.

What is claimed is:

1. A pixel circuit, comprising: a data writing circuit, a light-emitting drive circuit, and a voltage amplification circuit;

wherein the data writing circuit is electrically connected to a first node and is configured to write a data signal to the first node under control of a scan signal;

two ends of the voltage amplification circuit are electrically connected to the first node and a second node respectively, and the voltage amplification circuit are configured to obtain an amplified voltage signal based on the data signal and write the amplified voltage signal to the second node; and the light-emitting drive circuit is electrically connected to the second node and is configured to drive a light-emitting component to emit light under control of the amplified voltage signal, the voltage amplification circuit comprises at least one of a group consisting of a field effect transistor amplification sub-circuit and a bipolar transistor amplification sub-circuit, the bipolar transistor amplification sub-circuit comprises a first transistor, a bipolar transistor, a first resistor, a second resistor, a third resistor, and a first capacitor;

a first electrode of the first transistor is electrically connected with a first power terminal, and a second electrode of the first transistor is electrically connected with a first end of the first capacitor;

a first end of the first resistor is electrically connected with the first end of the first capacitor, and a second end of the first resistor is electrically connected with a control electrode of the bipolar transistor;

a first end of the second resistor is electrically connected with a second power terminal, and a second end of the second resistor is electrically connected with a first end of the third resistor;

a second end of the third resistor is electrically connected with a first electrode of the bipolar transistor;

a second electrode of the bipolar transistor is electrically connected with a third power terminal; and a second end of the first capacitor is electrically connected with a fourth power terminal.

2. The pixel circuit according to claim 1, wherein the voltage amplification circuit comprises a first-stage amplification circuit, the first-stage amplification circuit comprises a first bipolar transistor amplification sub-circuit, the first bipolar transistor amplification sub-circuit has a same structure as the bipolar transistor amplification sub-circuit, a control electrode of a first transistor of the first-stage amplification circuit is electrically connected to the first node, and a first end of a third resistor of the first-stage amplification circuit is electrically connected to the second node.

3. The pixel circuit according to claim 1, wherein the voltage amplification circuit comprises a first-stage amplification circuit and a second-stage amplification circuit which are cascaded, and the first-stage amplification circuit comprises a first bipolar transistor amplification sub-circuit, the second-stage amplification circuit comprises a second bipolar transistor amplification sub-circuit, the first bipolar transistor amplification sub-circuit has a same structure as the bipolar transistor amplification sub-circuit, and the second bipolar transistor amplification sub-circuit has a same structure as the bipolar transistor amplification sub-circuit;

a control electrode of a first transistor of the first-stage amplification circuit is electrically connected to the first node;

a first end of a third resistor of the first-stage amplification circuit is electrically connected with a control electrode of a first transistor of the second-stage amplification circuit; and a first end of a third resistor of the second-stage amplification circuit is electrically connected to the second node.

4. The pixel circuit according to claim 1, wherein the voltage amplification circuit comprises a plurality of amplification circuits which are cascaded, and each of the plurality of amplification circuits comprises a bipolar transistor amplification sub-circuit which has a same structure as the bipolar transistor amplification sub-circuit, in addition to a first-stage amplification circuit and a last-stage amplification circuit, a control electrode of a first transistor of a current-stage amplification circuit is electrically connected with a first end of a third resistor of a previous-stage amplification circuit; and a first end of a third resistor of the current-stage amplification circuit is electrically connected with a control electrode of a first transistor of a next-stage amplification circuit; and a control electrode of a first transistor of the first-stage amplification circuit is electrically connected with the first node, and a first end of a third resistor of the last-stage amplification circuit is electrically connected with the second node.

5. The pixel circuit according to claim 1, wherein a resistance value of the first resistor is smaller than a resistance value of the second resistor, and the resistance value of the second resistor is smaller than a resistance value of the third resistor.

6. The pixel circuit according to claim 1, wherein the field effect transistor amplification sub-circuit comprises a second transistor and a fourth resistor, a first electrode of the second transistor is electrically connected with a first power terminal, and a second electrode of the second transistor is electrically connected with a first end of the fourth resistor; and a second end of the fourth resistor is electrically connected with a third power terminal.

7. The pixel circuit according to claim 6, wherein the voltage amplification circuit comprises a first-stage amplification circuit, and the first-stage amplification circuit comprises a first field effect transistor amplification sub-circuit, and the first field effect transistor amplification sub-circuit has a same structure as the field effect transistor amplification sub-circuit, a control electrode of a second transistor of the first-stage amplification circuit is electrically connected with the first node, and a second electrode of the second transistor of the first-stage amplification circuit is electrically connected with the second node.

8. The pixel circuit according to claim 6, wherein the voltage amplification circuit comprises a first-stage amplification circuit and a second-stage amplification circuit which are cascaded, and the first-stage amplification circuit comprises a first field effect transistor amplification sub-circuit, the second-stage amplification circuit comprises a second field effect transistor amplification sub-circuit, the first field effect transistor amplification sub-circuit has a same structure as the field effect transistor amplification sub-circuit, and the second field effect transistor amplification sub-circuit has a same structure as the field effect transistor amplification sub-circuit, a control electrode of a second transistor of the first-stage amplification circuit is electrically connected with the first node;

a second electrode of the second transistor of the first-stage amplification circuit is electrically connected with a control electrode of a second transistor of the second-stage amplification circuit; and a second electrode of the second transistor of the second-stage amplification circuit is electrically connected with the second node.

9. The pixel circuit according to claim 6, wherein the voltage amplification circuit comprises a plurality of amplification circuits which are cascaded, and each of the plurality of amplification circuits comprises a field effect transistor amplification sub-circuit which has a same structure as the field effect transistor amplification sub-circuit, in addition to a first-stage amplification circuit and a last-stage amplification circuit, a control electrode of a second transistor of a current-stage amplification circuit is electrically connected with a second electrode of a second transistor of a previous-stage amplification circuit; and a second electrode of the second transistor of the current-stage amplification circuit is electrically connected with a control electrode of a second transistor of a next-stage amplification circuit; and a control electrode of a second transistor of the first-stage amplification circuit is electrically connected to the first node, and a second electrode of a second transistor of the last-stage amplification circuit is electrically connected to the second node.

10. The pixel circuit according to claim 1, wherein the field effect transistor amplification sub-circuit comprises a second transistor and a fourth resistor, a first electrode of the second transistor is electrically connected with a first power terminal, and a second electrode of the second transistor is electrically connected with a first end of the fourth resistor; and a second end of the fourth resistor is electrically connected with a third power terminal.

11. The pixel circuit according to claim 10, wherein the voltage amplification circuit comprises a first-stage amplification circuit and a second-stage amplification circuit which are cascaded, and the first-stage amplification circuit comprises a first bipolar transistor amplification sub-circuit, and the second-stage amplification circuit comprises a first field effect transistor amplification sub-circuit, the first bipolar transistor amplification sub-circuit has a same structure as the bipolar transistor amplification sub-circuit, and the first field effect transistor amplification sub-circuit has a same structure as the field effect transistor amplification sub-circuit;

a control electrode of a first transistor of the first-stage amplification circuit is electrically connected with the first node;

a first end of a third resistor of the first-stage amplification circuit is electrically connected with a control electrode of a second transistor of the second-stage amplification circuit; and a second electrode of the second transistor of the second-stage amplification circuit is electrically connected with the second node.

12. The pixel circuit according to claim 10, wherein the voltage amplification circuit comprises a first-stage amplification circuit and a second-stage amplification circuit which are cascaded, and the first-stage amplification circuit comprises a first field effect transistor amplification sub-circuit, and the second-stage amplification circuit comprises a first bipolar transistor amplification sub-circuit, the first bipolar transistor amplification sub-circuit has a same structure as the bipolar transistor amplification sub-circuit, and the first field effect transistor amplification sub-circuit has a same structure as the field effect transistor amplification sub-circuit;

a control electrode of a second transistor of the first-stage amplification circuit is electrically connected with the first node;

a second electrode of the second transistor of the first-stage amplification circuit is electrically connected with a control electrode of a first transistor of the second-stage amplification circuit; and a first end of a third resistor of the second-stage amplification circuit is electrically connected with the second node.

13. The pixel circuit according to claim 1, further comprising: a storage circuit, wherein the storage circuit is configured to store the amplified voltage signal, and the storage circuit comprises a second capacitor, the light-emitting drive circuit comprises a light-emitting drive transistor, and the data writing circuit comprises a data writing transistor;

a first electrode of the light-emitting drive transistor is electrically connected with a first drive power terminal, a second electrode of the light-emitting drive transistor is electrically connected with the light-emitting component, and a control electrode of the light-emitting drive transistor is electrically connected with the second node;

a first electrode of the data writing transistor is connected with a data line to receive the data signal, a second electrode of the data writing transistor is electrically connected with the first node, and a control electrode of the data writing transistor is connected with a scan signal line to receive the scan signal; and a first end of the second capacitor is electrically connected with the second node, a second end of the second capacitor is grounded or electrically connected to the first drive power terminal.

14. The pixel circuit according to claim 1, further comprising: a light-emitting control circuit, wherein the light-emitting control circuit is configured to control the light-emitting drive circuit to drive the light-emitting component to emit light under control of a light-emitting control signal, and the light-emitting control circuit comprises a light-emitting control transistor;

a control electrode of the light-emitting control transistor is configured to receive the light-emitting control signal, a first electrode of the light-emitting control transistor is electrically connected with the light-emitting drive circuit, and a second electrode of the light-emitting control transistor is electrically connected with the light-emitting component.

15. A driving method applied to a pixel circuit, wherein the pixel circuit comprises: a data writing circuit, a light-emitting drive circuit, and a voltage amplification circuit, the data writing circuit is electrically connected to a first node and is configured to write a data signal to the first node under control of a scan signal;

two ends of the voltage amplification circuit are electrically connected to the first node and a second node respectively, and the voltage amplification circuit are configured to obtain an amplified voltage signal based on the data signal and write the amplified voltage signal to the second node;

the light-emitting drive circuit is electrically connected to the second node and is configured to drive a light-emitting component to emit light under control of the amplified voltage signal, the voltage amplification circuit comprises at least one of a group consisting of a field effect transistor amplification sub-circuit and a bipolar transistor amplification sub-circuit, the bipolar transistor amplification sub-circuit comprises a first transistor, a bipolar transistor, a first resistor, a second resistor, a third resistor, and a first capacitor;

a first electrode of the first transistor is electrically connected with a first power terminal, and a second electrode of the first transistor is electrically connected with a first end of the first capacitor;

a first end of the first resistor is electrically connected with the first end of the first capacitor, and a second end of the first resistor is electrically connected with a control electrode of the bipolar transistor;

a first end of the second resistor is electrically connected with a second power terminal, and a second end of the second resistor is electrically connected with a first end of the third resistor;

a second end of the third resistor is electrically connected with a first electrode of the bipolar transistor;

a second electrode of the bipolar transistor is electrically connected with a third power terminal;

a second end of the first capacitor is electrically connected with a fourth power terminal, and the driving method comprises:

in a data writing phase, writing the data signal into the voltage amplification circuit, obtaining the amplified voltage signal by the voltage amplification circuit based on the data signal, and writing the amplified voltage signal into the light-emitting drive circuit; and in a light-emitting phase, driving the light-emitting component to emit light by the light-emitting drive circuit based on the amplified voltage signal.

16. The driving method according to claim 15, wherein in a case where the voltage amplification circuit comprises the bipolar transistor amplification sub-circuit, obtaining the amplified voltage signal by the voltage amplification circuit based on the data signal comprises:

writing the data signal to a control electrode of the first transistor, and controlling the first transistor to be in a saturated state to obtain a saturation current;

controlling the bipolar transistor to be in an amplification state, and amplifying the saturation current by the bipolar transistor to obtain an amplified current; and obtaining the amplified voltage signal based on the amplified current.

17. The driving method according to claim 15, wherein in a case where the voltage amplification circuit comprises the field effect transistor amplification sub-circuit, and the field effect transistor amplification sub-circuit comprises a second transistor and a fourth resistor; and obtaining the amplified voltage signal by the voltage amplification circuit based on the data signal comprises:

writing the data signal to a control electrode of the second transistor, and controlling the second transistor to be in a saturated state to obtain a saturation current; and obtaining the amplified voltage signal based on the saturation current and the fourth resistor.

18. A display panel, comprising a pixel circuit, wherein the pixel circuit comprises a data writing circuit, a light-emitting drive circuit, and a voltage amplification circuit, the data writing circuit is electrically connected to a first node and is configured to write a data signal to the first node under control of a scan signal;

two ends of the voltage amplification circuit are electrically connected to the first node and a second node respectively, and the voltage amplification circuit are configured to obtain an amplified voltage signal based on the data signal and write the amplified voltage signal to the second node;

the light-emitting drive circuit is electrically connected to the second node and is configured to drive a light-emitting component to emit light under control of the amplified voltage signal;

the voltage amplification circuit comprises at least one of a group consisting of a field effect transistor amplification sub-circuit and a bipolar transistor amplification sub-circuit, the bipolar transistor amplification sub-circuit comprises a first transistor, a bipolar transistor, a first resistor, a second resistor, a third resistor, and a first capacitor;

a first electrode of the first transistor is electrically connected with a first power terminal, and a second electrode of the first transistor is electrically connected with a first end of the first capacitor;

a first end of the first resistor is electrically connected with the first end of the first capacitor, and a second end of the first resistor is electrically connected with a control electrode of the bipolar transistor;

a first end of the second resistor is electrically connected with a second power terminal, and a second end of the second resistor is electrically connected with a first end of the third resistor;

a second end of the third resistor is electrically connected with a first electrode of the bipolar transistor;

a second electrode of the bipolar transistor is electrically connected with a third power terminal;

a second end of the first capacitor is electrically connected with a fourth power terminal.

* * * * *